United States Patent [19]

Klostermann

[11] Patent Number: 4,811,375

[45] Date of Patent: Mar. 7, 1989

[54] X-RAY TUBES

[75] Inventor: Heinrich F. Klostermann, Trumbull, Conn.

[73] Assignee: Medical Electronic Imaging Corporation, Fremont, Calif.

[21] Appl. No.: 893,152

[22] Filed: Aug. 18, 1986

Related U.S. Application Data

[63] Continuation of Ser. No. 326,752, Dec. 2, 1981, Continuation-in-part of Ser. No. 90,501, Nov. 1, 1979, Continuation-in-part of Ser. No. 71,192, Oct. 30, 1979.

[51] Int. Cl.[4] ..... H01J 35/10; H01J 35/00

[52] U.S. Cl. ..... 378/131; 378/141; 378/134; 378/121

[58] Field of Search ..... 378/125, 131, 134–136, 378/140–141, 128, 157, 121, 142

[56] References Cited

U.S. PATENT DOCUMENTS

| | | | |
|---|---|---|---|
| 1,688,854 | 10/1928 | Daumann | 378/140 |
| 1,717,309 | 6/1929 | Bouwers | 378/121 |
| 1,893,759 | 1/1933 | Bouwers | 378/131 |
| 2,029,584 | 2/1936 | Pieper | 378/121 |
| 2,118,413 | 5/1938 | Messick, Jr. et al. | 378/121 |
| 2,121,632 | 6/1938 | Gross et al. | 378/128 |
| 2,222,549 | 11/1940 | Verhoeff | 378/131 |
| 2,332,044 | 10/1943 | Bell | 378/125 |
| 2,336,769 | 12/1943 | Atlee | 378/131 |
| 2,345,723 | 4/1944 | Atlee et al. | 378/125 |
| 2,348,184 | 5/1944 | Atlee et al. | 378/136 |
| 2,407,857 | 9/1946 | Verhoeff | 378/142 |
| 2,549,614 | 4/1951 | Leighton | 378/128 |
| 2,890,358 | 6/1959 | Cummings | 378/131 |
| 3,452,193 | 6/1969 | Petersen | 378/157 |
| 3,452,232 | 6/1969 | Seki et al. | 378/134 |
| 3,679,927 | 7/1972 | Kirkendall | 378/161 |
| 4,024,424 | 5/1977 | Eggelsmann et al. | 378/131 |
| 4,068,127 | 1/1978 | Goodenough | 378/125 |
| 4,167,671 | 9/1979 | Boden et al. | 378/131 |
| 4,225,787 | 9/1980 | Shapiro et al. | 378/131 |
| 4,276,490 | 6/1981 | Saldinger | 378/197 |

OTHER PUBLICATIONS

"Foundations of Electromagnetic Theory", by Reitz, Milford & Christy, 3d Ed., Addison-Wesley Publ., 1979, p. 198.

*Primary Examiner*—Craig E. Church
*Assistant Examiner*—John C. Freeman
*Attorney, Agent, or Firm*—Flehr, Hohbach, Test, Albritton & Herbert

[57] ABSTRACT

An X-ray tube comprises a generally cylindrical evacuated metal tube envelope having an anode rotatably mounted therein. [The interior of the tube envelope adjacent the anode is provided with ceramic insulation to prevent flashover.] The anode is rotated by an external variable speed DC drive motor magnetically coupled through the tube envelope wall to the rotating anode assembly. [The tube envelope wall includes ferrous segments which minimize the gap in the magnetic coupling while permitting a thick and strong tube envelope wall. A variable speed DC motor or a variable speed air motor may be employed to drive the anode. In preferred embodiments, the anode drive means is electromechanically clutched to the anode, whereby the drive means can be brought up to the desired anode speed and thereafter clutched to the anode, the drive means acting as a flywheel to bring the anode quickly up to speed. Electromagnets operating as clutches are also employed. Additionally, the anode drive means may be operated at high speeds suitable for radiography, and the electromagnetic clutch means may be intermittently operated to maintain the anode rotating during fluroroscopy. When a radiograph is required in the midst of fluoroscopy, the electromagnetic clutch is actuated to bring the anode up to its full speed. Alternate drive means include a DC stator external of the tube envelope acting on an internal rotor mounted to rotate with the anode. The X-ray tube further comprises a cathode rotatably mounted in the tube envelope and incorporating plurality of cathode filaments. Cathode rotation drive means are provided for rotating the cathode to select the desired filament. The cathode drive means is preferably magnetically coupled through the tube wall in order to rotate the cathode. Anode drive means also include]. The DC drive motor includes a DC stator external of the tube envelope operating on a rotor having encapsulated rare earth magnets [and an AC stator operating on a squirrel cage rotor through a laminated segmented tube wall]. A fan is provided for air cooling of the tube envelope.

7 Claims, 14 Drawing Sheets

300
305
310
309
308
306
307
313
312
311
70

260
279
278
274
281a
296
295
280
293
275
277
281
284
288
283
282
285
276
287
286
289
291
272
267
266
265
268
290
269
270
292
68
72
78

SIGNAL GENERATOR
SPEED INDICATOR
SPEED CONTROL
SPEED INDICATOR
PULSE GENERATOR & TIMING
SPEED SELECTOR & CONTROL
S/N
N/S
N
S
14
15
20
220
221
223
224
225
226
230
235
236
237
240
241
242
243
244
245
246
247
250
251
252
253
254
255
256
257
38
45
46

FIG. 22
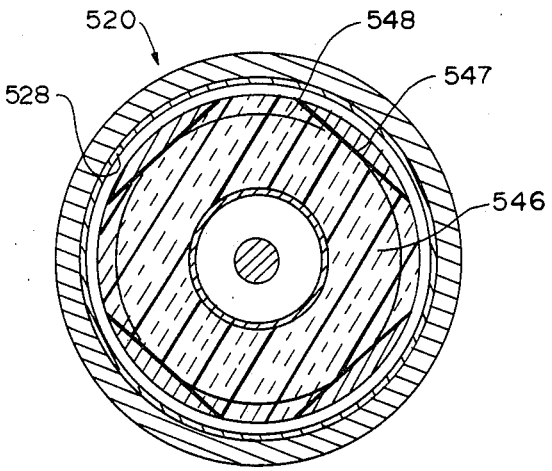
FIG. 21
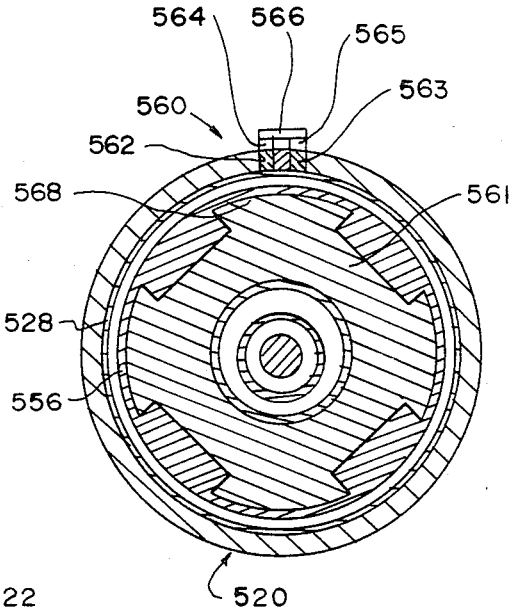
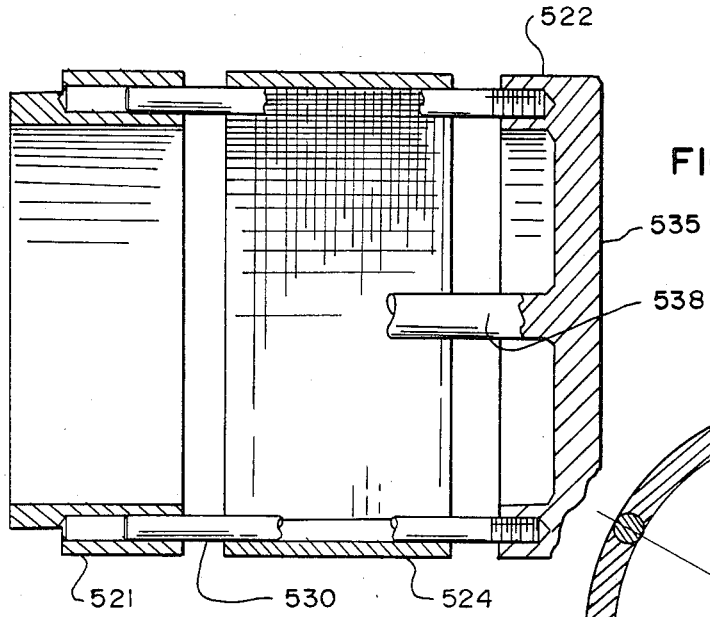
FIG. 23
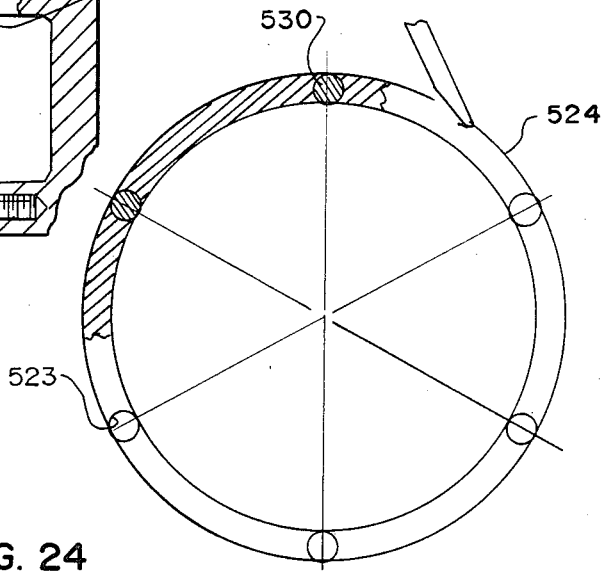
FIG. 24

X-RAY TUBES

This is a continuation of application Ser. No. 326,752 filed Dec. 2, 1981, which is a continuation-in-part of Ser. No. 90,501 filed Nov. 1, 1979, which is a continuation-in-part of Ser. No. 71,192 filed Oct. 30, 1979.

BACKGROUND OF THE INVENTION

This invention relates to improved X-ray tubes in general and more particularly to X-ray tubes with efficient rotation drives for the anode, with a rotational multiple focus cathode, and with a compact metal tube envelope.

The X-ray tube has become essential in medical diagnostics, medical therapy, and many parts of industry for material testing and material analysis. In X-ray medical diagnostics, rotating anode X-ray tubes are used almost exclusively to meet the demand for high quality X-ray imaging. On the other hand, many mobile X-ray units still utilize stationary X-ray tubes, but these units are very limited in application and, therefore, many mobile units now also incorporate a rotating anode tube.

Rotating anode X-ray tubes, which are capable of higher output for high quality imaging, were developed about 1920 as an improvement over stationary anode X-ray tubes with limited output. The first rotating anode X-ray tubes incorporated an induction motor operating from a standard 60 or 50 HZ power source, thus rotating the anode at about 3,300 rpm from a 60 cycle power. In the early 1950's, the so-called high speed (10,000 rpm) rotating anode X-ray tubes were developed to improve radiographic imaging further. In addition, in the 1950's a new area of radiology was developed, i.e. the study of the vascular system by injecting radio-opaque contrast media into the vascular system while simultaneously making single or multiple rapid sequence exposures. In addition, with the arrival of the image intensifier, X-ray motion picture studies were possible, putting even higher demands on the rotating anode X-ray tubes. X-ray tubes have become more complex and more expensive, and perhaps more fragile and prone to failure, in an effort to meet these demands.

Present rotating anode X-ray tubes have a cathode consisting of one or two filaments with corresponding focus cups, and a rotating anode assembly. These are mounted inside an all glass or a metal/glass evacuated tube envelope and the envelope is mounted inside an X-ray tube housing. The housing is filled with insulating oil, includes a heat expansion system and also incorporates the stator of an AC squirrel cage anode drive motor. The stator is generally concentric about the rotor of the anode drive motor, the rotor being part of the rotating anode assembly inside the vacuum tube envelope. Thus, the stator is spaced from the rotor by the thickness of the tube wall plus necessary clearances, which makes the squirrel cage motor inefficient and heat-producing.

X-rays are produced when the cathode filament is heated to a desired temperature and high voltage is applied between the cathode and anode. Maximum tube voltages of 100 KV, 125 KV or 150 KV across the cathode/anode gap are typical. Electrons flow in a narrow beam from the cathode to the anode at high acceleration and speed dictated by the high voltage. The electrons hit the anode and produce X-rays; however, only approximately 1% X-rays versus approximately 99% heat are produced for the amount of power applied. Due to this inefficienty in X-ray production, heat control and cooling are of major concern when designing modern high performance rotating anode X-ray tubes.

Most rotating anode X-ray tubes have two cathode filaments providing a smaller and a larger focus, depending upon which filament is heated. However, various X-ray techniques require differing foci, and typical nominal focal spot sizes required are: 0.1 $mm^2$, 0.3 $mm^2$, 0.6 $mm^2$, 1.0 $mm^2$, 1.2 $mm^2$, 1.5 $mm^2$, 1.8 $mm^2$ and 2.0 $mm^2$. Since present tubes provide only two foci, e.g. 0.6 $mm^2$ and 1.2 $mm^2$, one X-ray examination room for special procedure studies may require four X-ray tubes with each tube having different combinations of foci.

The most difficult design criteria of the high performance rotating anode X-ray tube is the anode/rotor structure. Today rotating anode X-ray tubes apply the AC squirrel cage induction motor principle, which basically is a two-pole frequency dependent motor. Therefore, 60 Hz provides a "standard" speed of approximately 3,300 rpm and 180 Hz provides a "high" speed of approximately 10,000 rpm. Since the rotor has to operate inside the vacuum, no conventional lubricants can be used for the ball bearings used to mount the anode/rotor structure. In addition, most manufacturers use the ball bearings as current carrier to the anode, and the current with many of the newer tubes may be in the range of 1,500 mA (milliamperes) to 2,000 mA at an anode voltage of for instance 100 KV. The current often pits the bearing surfaces, leading to vibration and failure. It should also be noted that, because of the two-speed motor drive, the anode is often rotated for fairly long periods at speeds higher than required by the operating power of the tube, and this also leads to tube failure.

Today, most all of the rotating anode X-ray tubes have the anode/rotor structure on high voltage anode potential, where the stator is at ground or near ground potential inside the tube housing surrounded by the insulating oil and other insulating material. A recent X-ray tube insulates the anode from the rotor. However, in either structure, there is a large gap between the stator and the rotor and a lot of stator power is required for fast acceleration and deceleration of the anode.

Radiography is a common medical X-ray procedure and may consist of: (a) radiography only, in which high or medium high power is directly applied to the X-ray tube after the anode is at standard or high speed, as required, and the filament is at the selected mA (filament temperature dictates the mA); or (b) combined radiography and fluoroscopy, in which television viewing precedes a radiographic exposure. Television viewing takes place at low tube power of around 100 Watts to 300 Watts but is continuous for long intervals followed by a high powered pulse of tube power for making a radiograph. This pulse, of from instance 100 Kilowatts, of course requires high speed rotation of the anode. The radiologist likes to instantly record what he may see on the television screen. Therefore, the time from fluoroscopy/television viewing to the radiographic pulse should be as short as possible. Less than one second changeover is desirable, but almost impossible with the new high performance high speed tubes. Even for a direct radiograph, such as a chest X-ray where no television viewing precedes the exposure, it is desirable to have a short time of less than one second start-up from zero to maximum anode speed, because the patient has to take a deep breath and hold it. In infant radiography, the technician may watch the infant's breathing and trigger the exposure when breathing of the infant is at a desired position. There are also automatic trigger devices, which allow selecting of the exposure trigger at any breath positon or for instance at any heart cycle position.

From the rotating anode point of view, these techniques require either a short start time, which requires a lot of power to the stator of the anode drive motor, or an advance start of long time with low power to the stator. The low power long advance start time system is shortening the tube life due to long rotation periods, and the other high power short start time systems create undesirable housing heat units which may be so high combined with the heat units coming from the anode that forced oil or water circulation may be required for keeping the X-ray tube housing temperature within its safety limits. In addition, the starter circuitry for fast acceleration of the rotor/anode structure is complex and expensive.

Overall, X-ray tubes have been developed to the point where they are highly useful but are also highly specialized, sophisticated and expensive structures with a relatively short use expectancy in view of their cost.

SUMMARY OF THE INVENTION

It is a principal object of the invention herein to provide an improved rotating anode X-ray tube.

It is an additional object of the invention herein to provide improved drive means for rotating the anode of a X-ray tube.

It is a further object of the invention herein to provide an X-ray tube which is adaptable for use in many X-ray procedures.

It is another object of the invention herein to provide an improved X-ray tube which is compact and lightweight.

It is yet another object of the invention herein to provide an improved X-ray tube which has a long service life and is relatively inexpensive.

An X-ray tube according to the invention herein has an anode rotatably mounted within a tube envelope, the anode being connected to an internal rotor which is magnetically coupled to external drive means for rotating the anode. The internal rotor is positioned closely adjacent the interior of the tube envelope and the tube envelope is provided with ferrous segments which form a part of flux loops coupling the internal rotor with the external drive means. Thus, the tube envelope may be relatively thick and structurally sound, and yet gaps in the magnetically-coupling flux loops are minimized. Alternatively, the drive coupling may be accomplished through a non-ferrous portion of the tube envelope with strong coupling elements.

In some embodiments the internal rotor comprises a permanent magnet and the external drive means also comprises a rotatably mounted permanent magnet external rotor coupled with the internal rotor. The external permanent magnet rotor is driven by a motor, preferably a variable speed DC or air turbine motor, and a clutch or clutch/brake may be used to couple the motor with the external permanent magnet motor. An additional permanent magnet may be provided with the rotatable anode, the additional permanent magnet being magnetically coupled to a non-driven permanent magnet which equalizes the axial force on the rotatable anode to minimize bearing wear. Radial configuration are also utilized to eliminate axial bearing loads.

The motor may be continuously clutched to the anode and operated to drive the anode at the desired speed for some X-ray procedures. In fluoroscopy procedures punctuated by intermittent radiographs, the motor may be driven at the speed required for radiographs and the clutch may be periodically pulsed to keep the anode rotating at a low speed for fluoroscopy. When a radiograph is desired, the clutch is turned on to bring the anode to high speed rotation for the radiographic exposure. The brake returns the anode to low speed after the radiographic exposure.

The speed of anode rotation is thus controllable by the variable speed motor, as well as by the technique of periodically pulsing the clutch, wherein the anode is generally rotated at the lower end of the safe speed range, prolonging bearing life and, therefore, overall tube life. The drive means makes a very small and insignificant contribution to the heat of the X-ray tube, and an air fan may be driven with the motor of the magnetic drive to create a flow of cooling air around the tube envelope. Alternatively, when an air drive is utilized, compressed air powers a turbine which drives the external rotor, and the air flow is regulated to provide the required speed. Exhaust from the air drive may be used for cooling.

The internal rotor may also be comprised of ferrous material driven by flux coupling to an external rotating electromagnet, or by an external stationary electromagnet used in conjunction with an external rotor of ferrous material.

The internal rotor may also be driven by the field of stator mounted outside the tube envelope surrounding the rotor portion of the anode/rotor assembly. In one such embodiment, the stator is a multiple pole DC stator having its pole shoes surrounding a cup portion of the tube envelope in which the rotor is closely received. The rotor comprises a plurality of bar magnets, preferably of the rare earth type, which extend outwardly from the surface of a ferrous sleeve and are separated by non-ferrous spacers. The rare earth magnets and sleeve are sealed in a non-ferrous casing to prevent the rare earth magnets from contaminating the vacuum in the tube envelope. The axial length of the permanent magnets is greater than that of the pole shoes, which biases the anode/rotor toward a structural stop at the cathode end of the tube to achieve stable cathode-anode spacing, and also provides for mounting a Hall device over the extending permanent magnets for switching current to the stator. The cup portion of the tube envelope between the rotor and stator may be either entirely non-ferrous or may comprise ferrous segments with non-ferrous spacers.

In another such embodiment, the stator and rotor comprise a brushless AC induction motor, also known as a squirrel cage motor. The stator pole shoes are deployed surrounding a cup portion of the tube envelope, the cup wall having ferrous segments separated by non-ferrous spacers to reduce the effective gap between the stator and rotor. the stator, rotor and ferrous wall segments are all preferably laminated to reduce eddy currents, and the wall has a thin sleeve to prevent vacuum leaks between the laminations. The rotor is fabricated and mounted to a ceramic insulator (which mounts the anode) by a copper casting process, in which the ferrous laminations of the rotor are aligned on the end of a ceramic insulator and liquid copper is flowed into open spaces in the laminations to form the longitudinal non-ferrous bars of the rotor and is also formed over the exterior of the rotor and the adjacent portion of the ceramic insulator to form a sleeve which secures the rotor to the ceramic insulator. The ceramic insulator is preferably configured so that the sleeve surrounds flat surfaces and grooves to achieve a strong connection. The rotor also preferably incorporates a cam having ferrous lobes which close a flux loop through an externally mounted magnet and Hall device, providing a speed monitor.

At least the main portion of the tube envelope surrounding the rotating anode is generally cylindrical and made of metal, preferably copper, which may be lined with ceramic insulating material. The end of the tube envelope opposite the anode target surface is not lined with ceramic for good transfer of heat from the anode, and the exterior of the tube envelope end may be finned to dissipate heat rapidly. The tube envelope may be mounted in a surrounding housing, and is air cooled.

The usefulness of a single X-ray tube is extended to a variety of X-ray procedures by providing a multiple filament rotatable cathode, the cathode being rotated through the tube envelope by magnetically coupled drive means. Thus, four or more focus sizes can be provided in a single tube, and the X-ray tube is highly flexible in its output end usefulness.

Other features of the X-ray tube according to the invention herein include embedding the cathode supply leads (both filament and grid) in the ceramic tube lining, whereby both the cathode and anode cables may enter the tube envelope generally opposite the X-ray window area, making the tube easy to mount and utilize in X-ray apparatus. Power to the anode is provided through a coupling separate and distinct from the bearings on which the anode is mounted, prolonging the life of the bearings. Improved cable terminations are also provided. In addition, some embodiments utilize a grounded cathode, which may be either rotatable or stationary, wherein the cathode supply leads are highly simplified.

All of the foregoing features combine to provide a vastly improved X-ray tube. Other and more specific features and objects of the invention herein will in part be obvious to those skilled in the art and will in part appear from the following description of the preferred embodiments and the claims, taken together with the drawings.

DRAWINGS

FIG. 21 is a sectional view of the Motor drive portion of the X-ray tube of FIG. 19 taken along the lines 21—21 of FIG. 19;

FIG. 22 is a sectional view of the X-ray tube of FIG. 19 taken along the lines 22—22 thereof;

FIG. 23 is a schematic view illustrating an assembly step in fabricating the X-ray tube of FIG. 19; and FIG. 24 is a schematic view also illustrating an assembly step in fabricating the X-ray tube of FIG. 19.

The same reference numerals refer to the same elements throughout the various Figures.

DESCRIPTION OF PREFERRED EMBODIMENTS

Figure 1:
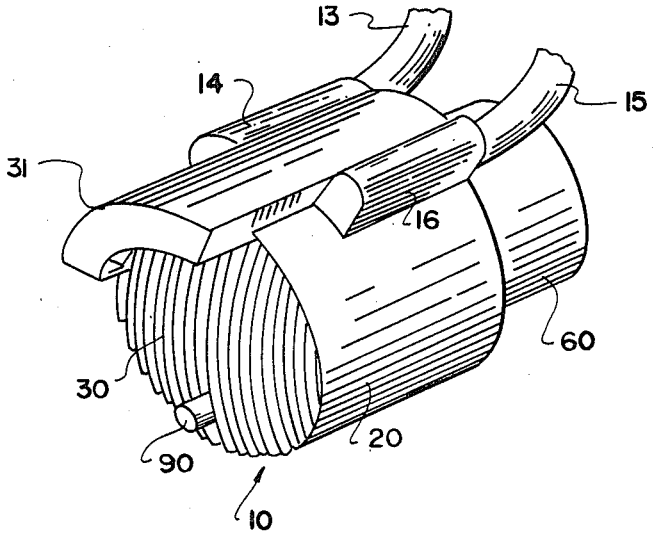
FIG. 1 is a perspective view of a first embodiment of an X-ray tube according to the invention herein.
Figure 4:
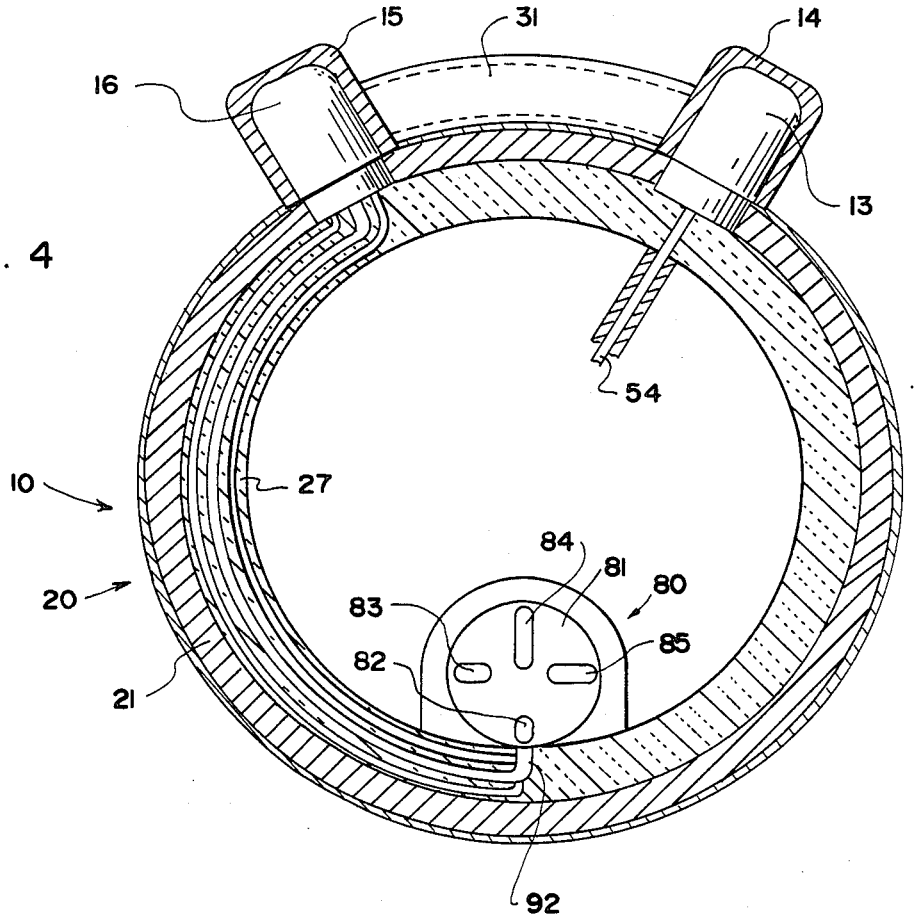
FIG. 4 is a sectional view of the X-ray tube of FIG. 1 taken along the lines 4—4 of FIG. 2.

With reference to FIGS. 1–4, an X-ray tube 10 according to the invention herein is illustrated. The X-ray tube 10 generally comprises a tube envelope 20, a rotating anode assembly 40 including anode 50 and a variable speed anode drive 60 magnetically coupled to rotate the anode assembly 40. The X-ray tube 10 further generally comprises a multiple filament cathode assembly 80 which is rotatably mounted for focus selection by means of an external drive motor magnetically coupled thereto.

The tube envelope 20 comprises an outer cylindrical wall 21, which is preferably fabricated of copper or another non-ferrous metal or metal alloy, such as aluminum or brass. Integral with the cylindrical outer wall 21 is an annular end wall 22 which has an outwardly projecting cup 23 for receiving and supporting the rotating anode assembly 40, as more fully discussed below. The cylindrical wall of the cup 23 is provided with spaced-apart ferrous metal segments 25 which form a portion of the anode drive 40, as also more fully discussed below.

The interior of the cylindrical wall 21 is provided with a matingly received cylindrical electrical insulator 27, which preferably has an inwardly extending flange 28 extending along the annular wall 22. The insulator 27 prevents flashover from the anode to the metal walls of the tube envelope, and mica ceramic is a suitable material for this purpose. At the opposite end of the cylindrical wall 21 a second end wall 29 of the tube envelope 20 is provided and the end wall 29 has cooling fins 30 on the outside surface thereof. The end wall 29 is threaded into and sealed to the cylindrical wall 21. No ceramic insulation is provided on the interior of the end wall 29, wherein radiant heat from the anode 50 is dissipated through the end wall 29 and the cooling fins 30. The thick metal end wall 29, and to some extent the rest of the metal tube envelope 20, acts as a heat sink for removing heat from the interior of the X-ray tube 10, and the tube envelope is air-cooled at its exterior.

The tube envelope 20 is also provided with a window 35 made of radiolucent material, such as glass beryllium, for permitting the escape of the X-rays produced by the tube. The ceramic insulator 27 defines an opening 32 to the window 35, and an off-focus radiation mask 33 may be mounted to the ceramic insulator 27 surrounding opening 32 to limit the beam passing through the window 35. The cylindrical wall 21, of course, also defines an opening 34 to expose the window 35. The exterior of the tube envelope 20 may be provided with a lead coating, indicated generally at 36, to absorb stray X-rays.

The rotating anode assembly 40 generally comprises an anode 50 mounted for rotation with a shaft 45. More particularly, the shaft 45 is mounted via thrust bearings 46 and 47, thrust bearing 47 being received in a pocket in the end wall of cup 23 and thrust bearing 46 being mounted on a disc 38 which is secured to the tube envelope, such as by threading it into the base of the cup 23 on the interior of the tube envelope 20. A flat metal disc 48 integral with the inner end of the shaft 45 has a ceramic disc 41 mounted thereto, the ceramic disc 41 having a beveled forward surface 42, and a central projecting stud 43.

The anode 50 takes the shape of an annular disc having a center opening 53 which is threaded or otherwise adapted to secure the anode to the protruding stud 43 of the ceramic disc 41. The stud 43 may have a threaded metal sleeve for this purpose. The anode has a beveled forward surface 51 and also has a beveled rear surface 52, wherein a gap is created between the forward beveled surface 42 of the ceramic disc and the rear surface 52 of the anode. This permits heat to be dissipated from the rear of the anode. The anode material may vary according to the proposed use of the X-ray tube, but typically the target surface on the forward beveled surface 51 may be rhenium tungsten which maintains its smooth surface over long periods of high load exposure. The rhenium tungsten is typically applied to a body of molybdenum. The diameter of the anode may be three, four or even five inches or 7.62, 10.16 and 12.70 centimeters respectively although higher power tubes generally utilize a four inch or 10.16 centimeter anode. Of course, the tube envelope is sized to accept the chosen diameter of the anode. The bevel on the front surface 51 of the anode 50, also known as the target angle, is commonly between ten and fifteen degrees. The total anode weight may be in the range of approximately 500 to 1100 grams, i.e. approximately one to two pounds. It will be appreciated that anode design is well known in the art, and is not a particular feature of the invention herein. For instance, X-ray tube anodes having a lighter weight graphite body and a rhenium tungsten surface have been proposed in recent years but have encountered some technical difficulties, and such anodes may be incorporated into the X-ray tube of the invention herein as the difficulties are solved.

The anode is maintained at a high positive voltage during tube operation. An anode cable 13 connected to the housing at a terminal 14 supplies the high voltage. An insulated conductor 54 extends from the anode cable 13 through the ceramic insulator 27 to adjacent the end of the ceramic stud 43, where it connects with a conductive stud 55. A ball 56 is spring biased outwardly from the stud 55 into engagement with a conductive cup 57 mounted in a recess in the stud 43 of ceramic disc 41, and the cup 57 is electrically connected to the anode by a lead 58 embedded in the ceramic stud 43. Thus, the positive voltage is applied to the anode 50 without utilizing the bearings 46, 47 of the rotating anode assembly 40 as conductors.

Figure 3:
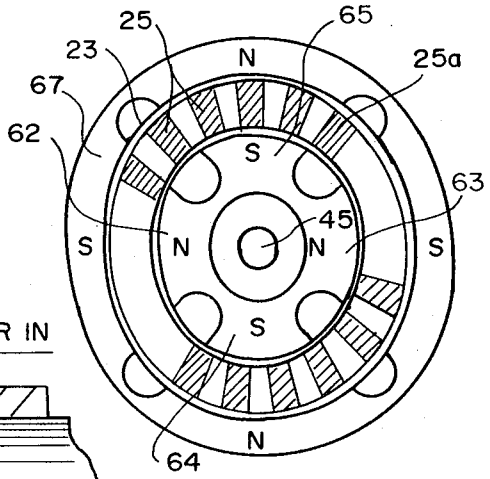
FIG. 3 is a sectional view of the X-ray tube of FIG. 1 taken along the lines 3—3 of FIG. 2.
Figure 2:
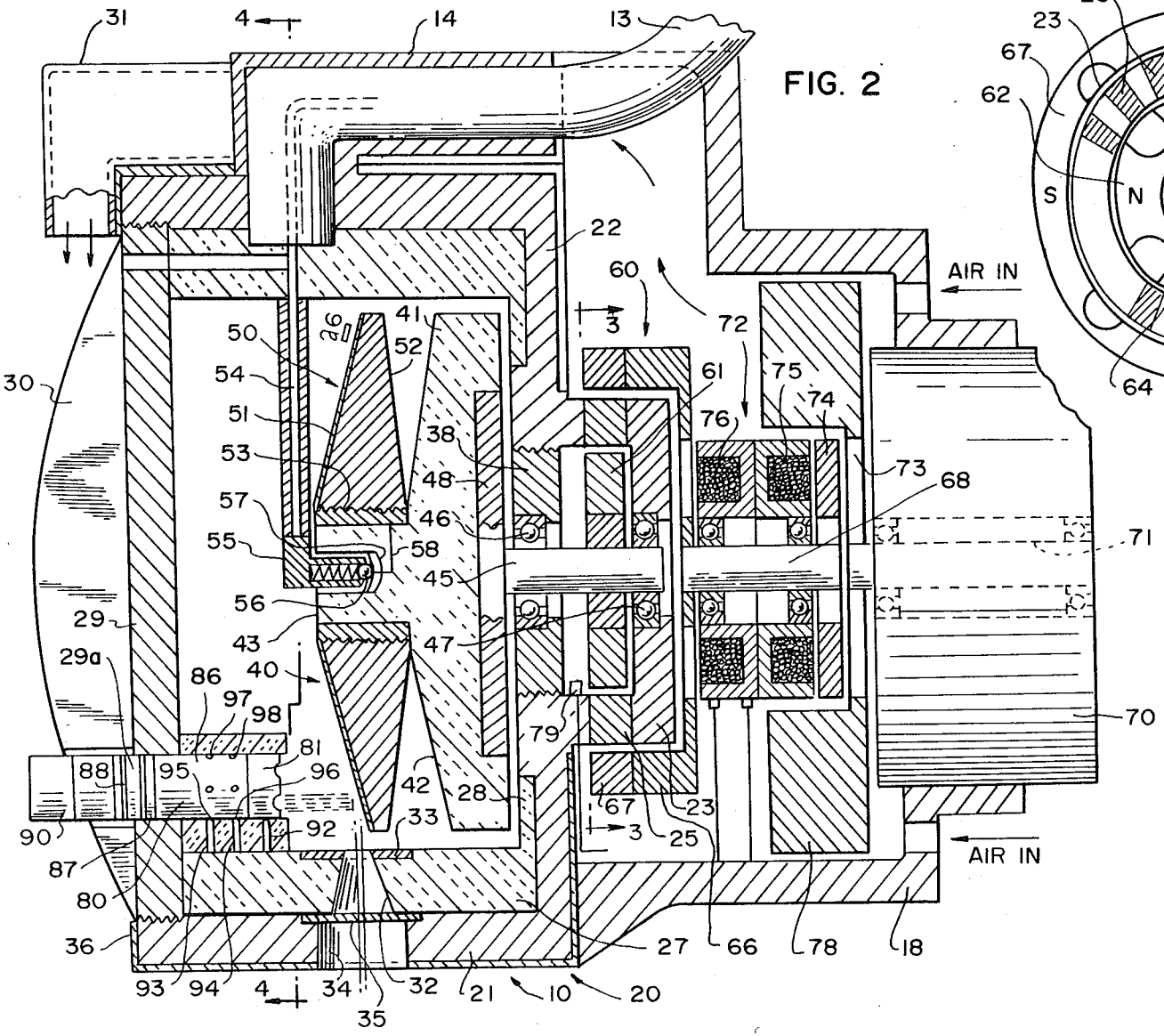
FIG. 2 is a longitudinal sectional view of the X-ray tube of FIG. 1.

The anode drive 60 of the X-ray tube 10 is characterized by the anode 50 being magnetically coupled to external drive means, with the tube envelope providing for good magnetic coupling without sacrifice of strength. The anode drive motor 60 first comprises a permanent magnet 61, generally in the configuration of a disc, mounted to shaft 45 whereby the anode 50 turns with the permanent magnet 61. As best seen in FIG. 3, permanent magnet 61 may be multipolar, i.e. having a plurality of alternate north and south poles. In the embodiment illustrated, two opposed north poles 62 and 63, respectively, flank two opposed south poles 64 and 65. An external rotor 66 is mounted on the shaft 68, the rotor 66 being generally cup shaped and disposed over the cup 23 of the tube envelope 20. The rotor 66 includes a permanent magnet 67 lying generally in the same plane as the permanent magnet 61 and having an equal number of poles as the permanent magnet 61, whereby the permanent magnets 61 and 67 are magnetically coupled together by the attraction of their opposite poles, as best illustrated in FIG. 3. Thus, when the rotor 66 is rotated, the permanent magnet 61 and thereby also the anode 50 are rotated.

It will be appreciated that the strength of the magnetic coupling between the magnet 67 and the magnet 61 decreases as the separation between them increases, i.e, the larger the air gap between the magnetic poles the less the strength of the magnetic coupling. As a feature of the present invention, the cylindrical wall of the cup 23 is provided with a plurality of spaced-apart ferrous metal segments 25 which maintain the strength of the magnetic coupling between the magnets 61 and 67, and yet permit the tube envelope to have sufficient thickness and strength so as to support the rotating anode assembly and to be durable in general. With reference to FIG. 3, flux lines between the juxtaposed north and south poles of the permanent magnets 61, 67 pass through the ferrous metal segments 25, and the only air gaps in the magnetic coupling are those between the permanent magnets 61, 67 and the interposed tube envelope wall. This air gap can be maintained at a very small dimension, although it is shown somewhat exaggerated in the figures for purposes of clarity. It will be appreciated that the ferromagnetic segments which are not positioned between juxtaposed north and south poles, for instance segment **25*a* in FIG. 3**, carry no flux when in the position shown, but do carry flux as the permanent magnets rotate.

The ferrous metal segments 25 are separated from each other so that they do not in and of themselves create a flux loop which would defeat coupling between the permanent magnets 61 and 67. Accordingly, the portion of the tube wall between the ferrous metal segments should not be of magnetic or magnetizable material. Aluminum will suffice for this purpose, albeit with some losses via eddy currents, and it may also be desirable to use glass between the ferrous metal segments 25. The external drive means for the rotor 66 comprises a variable speed DC motor 70 coupled to the rotor 66 through a combination electromagnetic clutch and brake 72. The DC motor 70 and the electromagnetic clutch/brake 72 are mounted on brackets, generally indicated at 18, which are secured to the tube envelope 20. The motor shaft 71 has mounted thereto the first clutch plate 73 of the electromagnetic clutch/brake 72, and the shaft 68 is supported in the electromagnetic clutch/brake 72 and has the second clutch plate 74 on its end facing the first clutch plate 73. The clutch electromagnet 75 operates to bring the plates 73, 74 together to drive the rotor 66 and hence the anode 50.

The anode 50 is braked by pulsing the brake electromagnet 76 (while the clutch electromagnet 75 is off), which brings a frictional surface of the rotor 66 against a second frictional surface on the brake electromagnet. The brake feature is desirable to avoid having the anode 50 coast at high rpm after use of the X-ray tube, which causes needless wear on the bearings. The electromagnet clutch/brake assembly is a well known commerically available device.

The variable speed DC motor 70 is capable of operation 10,000 or more rpm for high speed rotation of the anode necessary in radiography. A lower speed motor may be used through a gear or pulley drive with appropriate multiplication. The use of a variable DC motor with magnetic coupling to the anode is highly advantageous over the squirrel cage AC motor of prior art X-ray tubes. There is less heat input from the DC motor in the area of the tube envelope, where cooling is already a problem. The variable speed DC motor also permits flexibility in the speed of the anode rotation, rather than a limited selection of two fixed speeds. Also, support electronics are simplified, inasmuch as the variable speed DC motor requires only a variable DC power supply.

The drive arrangement of the X-ray tube 10 is also highly useful in adapting it for combination fluoroscopic and radiographic procedures. As one mode of operation, the variable speed DC motor may be opeated at the desired rpm of the anode and continually clutched with the anode for fluoroscopy, and be provided with a high voltage to accelerate the anode to high speed rotation for radiography. Alternatively, the variable DC motor can be run at the high speed required for radiographic exposure, and the clutch electromagnet 75 can be periodically pulsed to maintain the anode 50 rotating at or somewhat above the speed required for fluoroscopy. When it is desired to make a radiographic exposure, the clutch electromagnet 75 is turned on to lock the anode with the motor, and the anode is brought up to speed quickly for the radiographic exposure.

A speed sensor 79, which may be electromagnetic, fiber optic photoelectric, etc., is provided to monitor the speed of rotation of the anode 50. Thus, radiographs can be made as soon as the anode is up to speed. The sensor also may be used to determine when to pulse the electromagnetic clutch during fluoroscopy to keep the anode at the required speed.

The rotating clutch plate 73 is preferably provided with fan blades 78 providing an air flow which is directed through a duct 31 mounted on the outside of the tube envelope 20, the duct 31 directing the cooling air to flow over the cooling fins 30 of the tube envelope 20.

The X-ray tube 10 further comprises a cathode assembly 80, which according to one feature of the invention herein rotates to provide for multiple foci. With reference to both FIGS. 2 and 4, the cathode assembly 80 includes a metal cathode 81 provided with four filaments 82–85, each of the four filaments 82–85 providing a different focus size of the X-ray tube 10. It will be appreciated that the number of filaments is not necessarily limited to four, and could be higher if desired. The cathode 81 is mounted to a ceramic cylinder 86 having a polarized permanent magnetic disc 87 on its end surface opposite the cathode 81. The end wall 29 of the tube envelope is provided with a thin portion **29*a*, and the magnetic disc 87 is positioned closely adjacent thereto. The cathode 80, ceramic cylinder 86 and disc 87 are mounted for rotation about their longitudinal axis within the tube envelope 20**.

On the outside of the tube envelope 20 a second polarized permanent magnetic disc 88 is positioned juxtaposed the polarized permanent magnetic disc 87, and the discs 87 and 88 are magnetically coupled together to maintain their orientation with respect to each other within close tolerances. A precision stepping motor 90 is mounted to the housing and mounts the magnetic disc 88, whereby the precision stepping motor 90 may turn the polarized magnetic disc 88 and thus also turn the polarized magnetic disc 87 and the cathode 81. Thus, a selected one of the four filaments 82–85 may be brought into the proper position for providing electrons from the cathode to the anode of the X-ray tube.

Power to the cathode is provided through a cathode cable 15 which enters the tube envelope at terminal 16. The cathode cable has three conductors, one of which applies the negative potential to the cathode, and the other two of which apply filament current to the selected cathode filament. The first conductor, which is also known as the cathode bias conductor, is connected to a terminal 92 embedded in the ceramic insulator 27 adjacent the cathode 81, and makes contact with the cathode 81. The filament conductors are connected with terminals 93 and 94 embedded in the ceramic adjacent the ceramic disc 88 of the cathode assembly 80. Each cathode filament has a pair of terminals on the outside surface of the ceramic cylinder 86, e.g. terminals 95 and 96 and terminals 97 and 98. As the cathode assembly 80 is rotated to select one of the filaments 82–85, the terminals associated with that filament contact the terminals 93 and 94 for providing the filament current. The cathode conductors are preferably embedded in the ceramic insulator 27, as indicated at 92 in FIG. 2, wherein the cathode cable terminal 16 may be positioned on the tube envelope at generally opposite the X-ray window 35. This leaves the window area of the X-ray tube 10 open and uncluttered, thus simplifying the mounting of the X-ray tube 10 in X-ray apparatus.

It should also be noted that the X-ray tube 10 is quite simple to assemble. The metal portion of the tube envelope 20 may be machined from a single piece of metal, or may be made of several pieces welded together. The ceramic insulator 27 is inserted and secured, and the rotating anode assembly is also inserted and secured, all from the open end of the tube envelope. The end wall 29 is then secured and sealed, and the tube is evacuated. Further, if the X-ray tube does not fail catastrophically, it can be rebuilt by removing the end wall 29.

Figure 5:
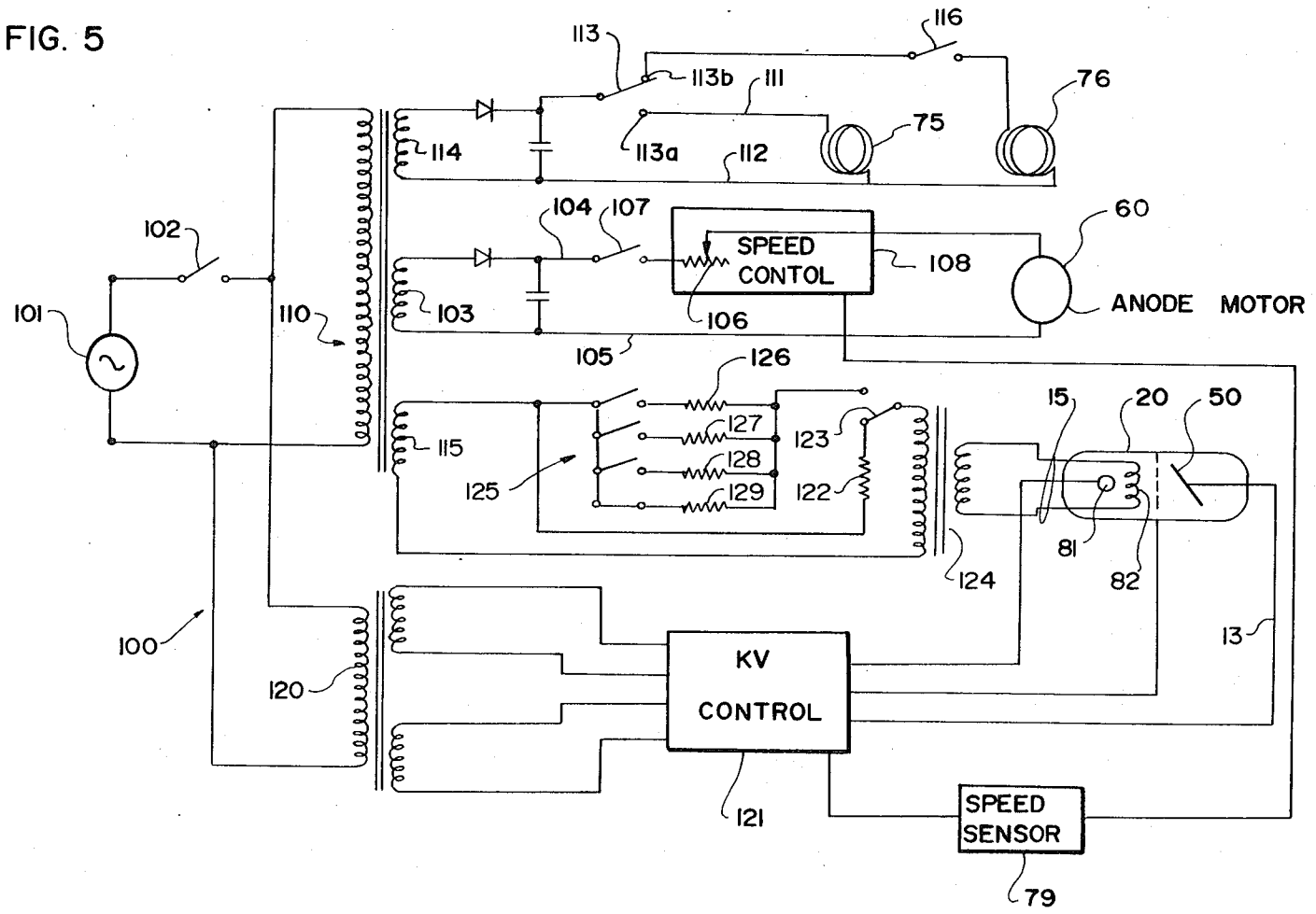
FIG. 5 is a schematic circuit diagram of an electrical circuit for operating the X-ray tube of FIG. 1.

With reference to FIG. 5, a diagram of a simplfied circuit 100 for use with the X-ray tube 10 is shown. The circuit 100 draws power from a source 101 and is turned on by a switch 102 to provide current through the primary windings of transformers 110 and 120. A secondary winding 103 of transformer and DC rectifier provide a DC voltage across lines 104 and 105 for operating the anode drive motor 70. An adjustable resistor 106 or other suitable means forming a part of a motor speed control 108 is used to select the speed of the motor, and a switch 107 is used to turn the motor on and off, as desired. The output of the speed sensor 79 may also be provided to the speed control 108 whereby the power to the motor may be adjusted to achieve the desired speed. Thus, the anode drive motor 60 can be run at any speed up to its maximum, which is typically 10,000 rpm (or less with a multiplication drive) to rotate the anode 50. Another secondary winding 114 of transformer 110 together with a rectifier provide DC voltage across leads 111 and 112 to power the electromagnetic clutch/brake 72. Closing the switch 113 to terminal 113*a* provides the voltage to the electromagnet 75 for driving the anode, and closing switch 116 when switch 113 is closed to terminal 113*b* operates the electromagnet 76 for braking.

An additional secondary winding 115 of the transformer 110 is utilized to provide power to the filament, filament 82 being shown selected in FIG. 5. It is desirable to preheat the filament, and this is accomplished by providing current through resistor 122 and prep switch 123, the prep current being provided to the filament 82 through an additional filament transformer 124 and the cathode leads as described above. Since there are four cathodes and each may require a different current, four resistors 126–129 are provided and the proper resistor for the selected filament is selected via the switches 125. The switches 125 are shown connecting resistor 129 into the circuit, and when the prep switch 123 is operated to connect the resistor 129 with the filament 82, the proper filament current is supplied.

The circuit 100 further comprises a transformer 120 providing power to a KV control unit 121, as is known in the art for providing a voltage across the anode to cathode gap. The output of the speed sensor 79 may be provided to the KV control and utilized to prohibit anode to cathode voltages greater than is safe for the speed of anode rotation. Although the circuitry for the precision stepping motor 90 is not illustrated in FIG. 5, it is well known in the art, and the stepping motor is used as described above to change which filament is connected into the circuit and thus the focus of the X-ray tube.

When using the X-ray tube 10, the user first selects one of the filaments to provide the desired focus, and the power level is also selected via the KV control. Contrary to prior art tubes wherein the rotor could either be stationary, operating at approximately 3300 rpm or operating at approximately 10,000 rpm, in the X-ray tube 10 the anode rotation speed can be selected via the variable speed motor such that the anode rotation speed is sufficiently high for the power being utilized, but is not unnecessarily high. This minimizes bearing wear and prolongs the life of the tube.

If the X-ray tube is to be continuously operated, such as in a fluoroscopy procedure, the DC motor may be operated at a low speed with the clutch electromagnet 75 continuously "on" to drive the anode 50 at low speed. If the procedure is to be radiographic only, the anode motor may be set at a high speed before energizing the clutch electromagnet 75. Just prior to the exposure, the electromagnet 75 is turned on to bring clutch plates 73 and 74 together and bring the anode up to speed quickly. Alternatively, the clutch can be operated as the motor 70 is turned on so that the anode comes up to speed with the motor. The electromagnet 75 is turned off promptly after the exposure, and a brake electromagnet 76 is then operated to limit the rotation time of the anode. If a combined procedure is to be undertaken, i.e. fluoroscopy with intermittent radiograph, the anode motor can be run at the speed required for the radiograph and the electromagnet 75 can be pulsed occasionally to keep the anode spinning during fluoroscopy. When the radiologist requires a radiograph, the electromagnet 75 is turned on to operate the clutch and bring the anode up to speed for the radiograph, and after the radiograph the brake may be used to bring the anode down to a lower speed for continued fluoroscopy. The motor can also be operated to drive the fan 78 to cool after the X-ray procedure is concluded.

A different focus for the X-ray tube may be selected by operating the stepping motor 90 to rotate the cathode 81, and the cathode to anode potential and anode rotation speed are easily altered as required for the particular desired X-ray procedure.

Thus, the X-ray tube 10 is extremely flexible and adaptable to a wide variety of X-ray procedures, and can do the work of several prior art tubes. Because rotation of the anode is limited in duration, the X-ray tube also has a long life expectancy, and it can also be fabricated less expensively than prior art tubes. In addition, if the motor or other external portion of the anode drive fail, they can be replaced without difficulty, and a major rebuilding of the tube or scrapping of the tube altogether is not required.

Figures 6, 7:
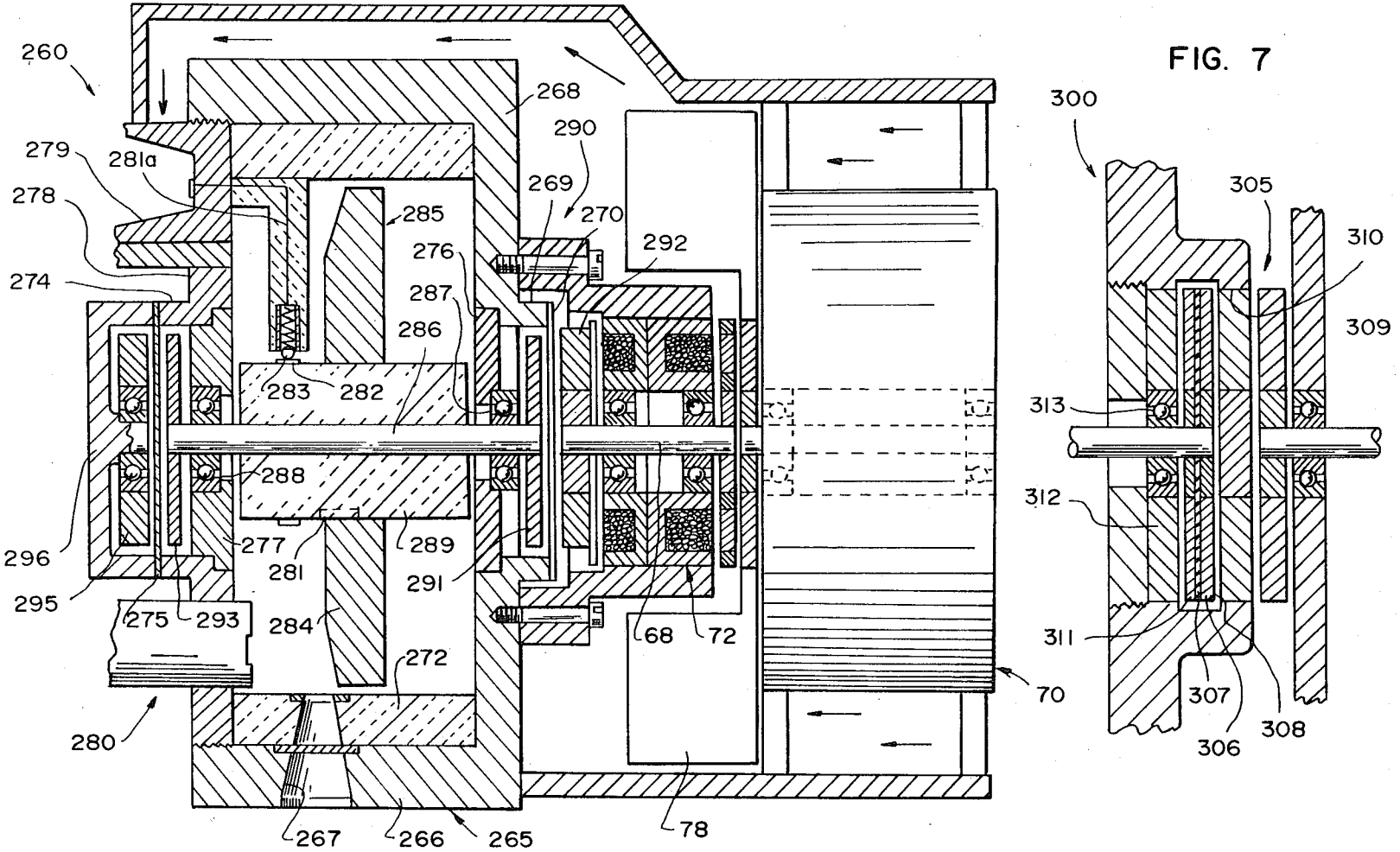
FIG. 6 is a longitudinal sectional view of another X-ray tube according to the invention herein.
FIG. 7 is a fragmentary longitudinal sectional view of another X-ray tube according to the invention herein.

With reference to FIG. 6, an X-ray tube 260 according to the invention herein is illustrated. The X-ray tube 260 generally comprises a tube envelope 265, a cathode 280, a rotating anode assembly 285 and anode drive means 290. The anode drive means 290 is characterized by axial magnetic coupling and includes compensation for the axial loads which would otherwise be imposed upon the bearings.

The tube envelope 265 comprises a cylindrical outer wall 266, which is provided with an X-ray window opening 267. The cylindrical outer wall 266 is closed by a first end wall 268 which is provided with a shallow cup 269 including a cup end wall 270 of a thin nonferrous material such as glass. The generally cylindrical outer wall 266 is provided with a cylindrical ceramic liner 272. A second end wall 273 of the tube envelope 265 may be threaded into the cylindrical outer wall 266 opposite the end wall 268, and the end wall 273 also includes a shallow cup 274 itself having a thin end wall 275 of nonferrous material such as glass. The end wall 273 may also mount the cathode 280, which may be either a fixed cathode or a multiple filament rotatable cathode as described in the X-ray tube 10 above.

The anode assembly 285 of X-ray tube 260 includes a shaft 286, one end of which is mounted on bearings 287 supported by a disc 276 which is threaded into or otherwise secured to the end of wall 268 of the tube envelope 265, the disc 276 generally sealing off the opening to the shallow cup 269. The other end of shaft 286 is rotatably supported in bearings 288 which are mounted in a disc 277 threaded into or otherwise secured to the end wall 273 of the tube envelope at the shallow cup 274. The shaft 286 is surrounded by a cylindrical ceramic insulator 289, which mounts the anode 284. Power is supplied to the anode through a conductive ball 283 biased against a slip-ring 282 on the ceramic insulator 289 with a lead 281 connecting the slip-ring and the anode 284. An insulated lead 281*a* connects with a terminal 279 for an anode supply cable, not shown, the terminal 279 being mounted on the end wall 273 of the tube envelope.

The anode drive means 290 comprises a first internal rotor 291 which is mounted to the shaft 286 and is positioned within the cup 269 closely adjacent its end wall 270. An external permanent magnet rotor 292 magnetically couples with the internal rotor 291 through the end wall 270 of the shallow cup 269, and it should be noted that the internal rotor may be a permanent magnet to enhance coupling or may be of partially ferrous material configured to couple with the permanent magnet of the external rotor. The external rotor 292 is mounted to a shaft 68 of an electromagnetic clutch/-brake assembly 72, which is driven by a variable speed DC motor 70, as described above with respect to X-ray tube 10.

The magnetic coupling between the external rotor 292 and the internal rotor 291 produces an axial load on the bearings 287 and 288, which is undesirable. It should be noted that the bearing 287 and 288 are in the evacuated interior of the tube envelope and accordingly cannot be lubricated, so that any excessive bearing loads are detrimental. To compensate, a second internal rotor 293 is mounted to the opposite end of the shaft 286, the internal rotor 293 being positioned in the shallow cup 274 closely adjacent its end wall 273. The second internal rotor 293 is magnetically coupled to a freely-wheeling external permanent magnet rotor 295 which is rotatably mounted in a cap 296 mounted to the cup end wall 273. The second set of rotors 293, 295 do not drive or interfere with the driving of the anode 285, but act to offset and counter balance the axial force developed along shaft 286 by the coupling of the first set of rotors 291, 292, thus minimizing bearing wear.

It should be noted that the discs 276 and 277 which support the bearings at 287, 288 and thus the shaft 286 also act as heat shields for the internal rotors 291 and 293, which is of value if the rotors 291, 293 are permanent magnets because some of the better permanent magnet materials are somewhat heat sensitive. It should also be noted that the end walls 270 and 275 of the cups 269 and 274 may also be segmented with alternating ferrous metal segments and nonferrous metal segments, if desired, to provide a thicker wall with minimal diminution of coupling power.

With reference to FIG. 7, a fragmentary portion of the anode drive 305 of an X-ray tube 300 is illustrated. The X-ray tube 300 is quite similar to the X-ray tube 260 described above; however, the compensation for axial coupling forces is accomplished at one end of the tube envelope.

More particularly, the anode drive 305 has an internal rotor 306 divided in a radial plane by insulator 307. On one side of the insulator 307 is either a permanent magnet or disc including a shaped ferrous material 308, as described, which couples with an external permanent magnet rotor 309 through wall 310 of the tube envelope. The external rotor 309 is driven by a motor, preferably through an electromagnetic clutch/brake assembly as described above and not repeated in FIG. 7. On the other side of the insulator 307 the internal rotor 306 comprises a ferrous disc 311 which is attracted by a permanent magnet 312 mounted within the tube envelope. The magnetic attraction between the permanent magnet 312 and the ferrous disc 311 balances the axial coupling forces between portion 308 of the internal rotor 306 and the permanent magnet external rotor 309, thus minimizing the axial load on the bearings, including bearings 313, which support the anode.

Figure 8:
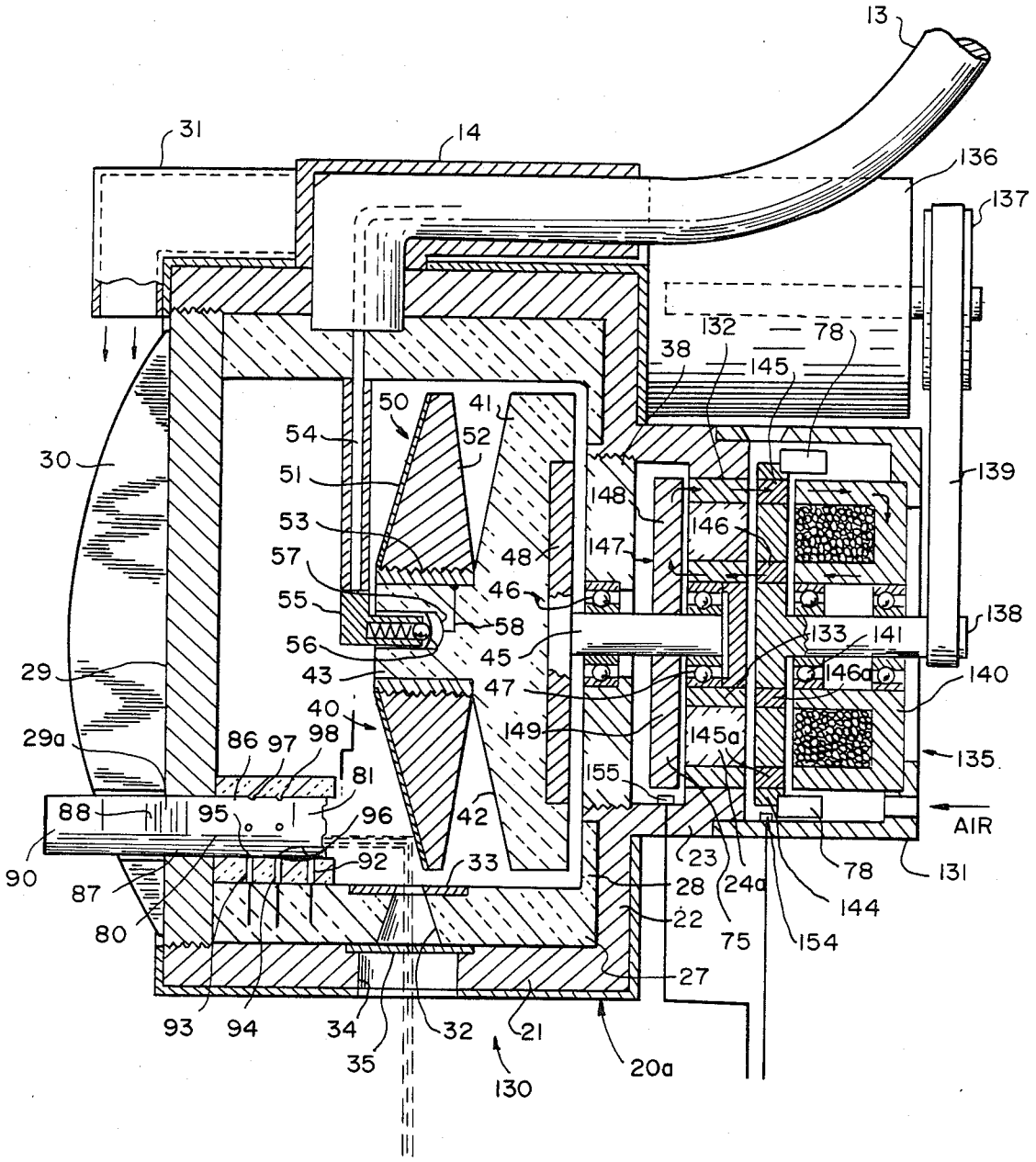
FIG. 8 is a longitudinal sectional view of anothr X-ray tube according to the invention herein.
Figure 9:
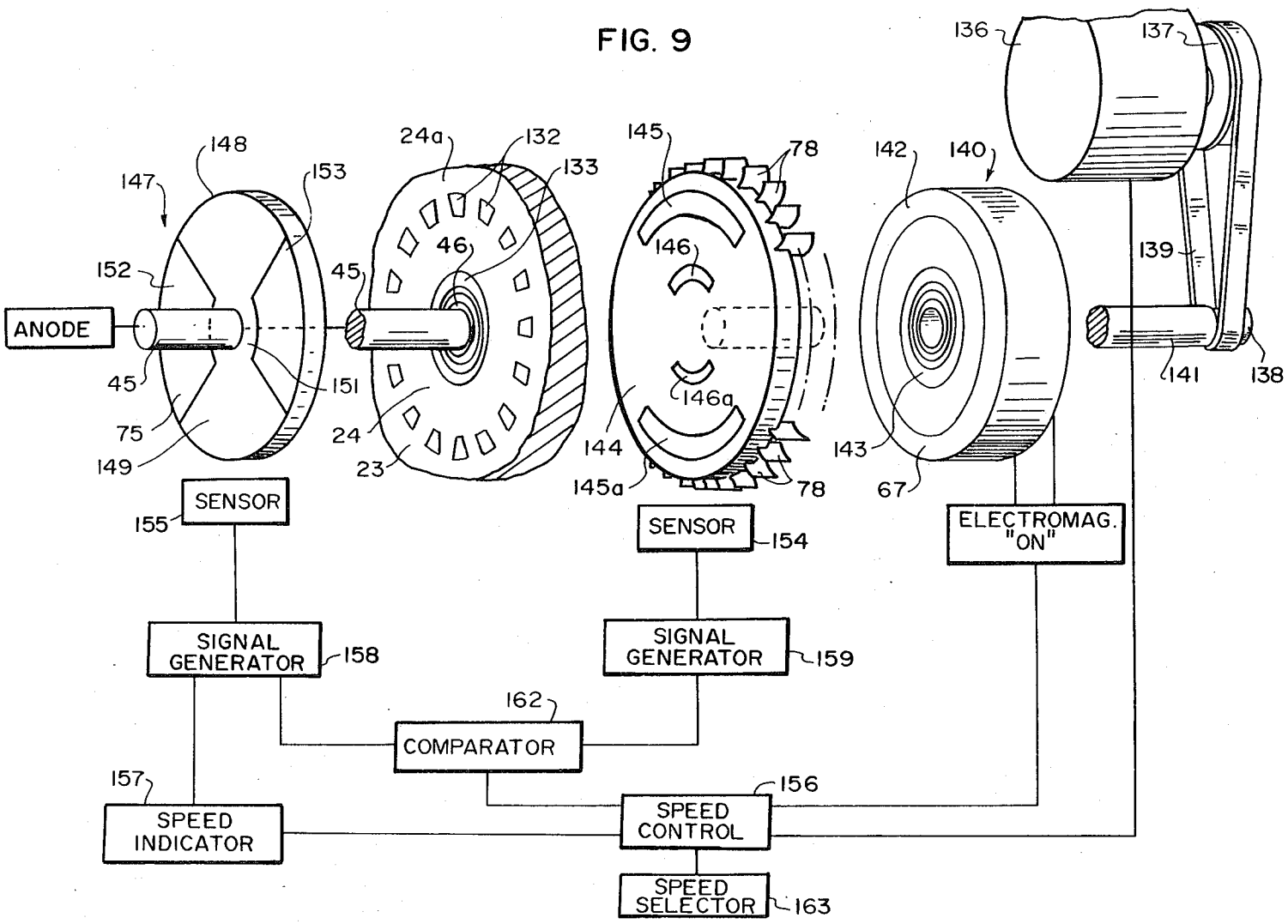
FIG. 9 is an exploded perspective view, partially schematic and partically cut away, of the anode drive of the X-ray tube of FIG. 8.

With reference to FIGS. 8 and 9, another X-ray tube 130 according to the invention herein is illustrated. The X-ray tube 130 is similar to X-ray tube 10 described above in its cathode assembly and rotating anode assembly, but incorporates a different anode drive which is generally indicated at 135. The tube envelope 20a of the X-ray tube 130 is also somewhat modified for use with the anode drive 135, as will be described below. The cathode circuitry may be the same as described above.

The anode drive 135 of the X-ray tube 130 first comprises a variable speed DC motor 136 which drives a pulley 137. The pulley is connected to and thereby drives a shaft 138 via a belt 139, the pulley and shaft circumferences being selected to provide the desired speed ratio. For instance, the DC motor 136 may have a maximum speed of 3400 rpm, and the pulley may be selected to turn the shaft 138 at a maximum speed of approximately 10,000 rpm. The shaft 138 is aligned with the shaft 45 of the rotating anode assembly 40. The shaft 138 is mounted on bearings 141 supported by an annular electromagnet 140, which is in turn supported on a bracket 131 extending from the rear of the tube envelope 20*a*. As best seen in FIG. 9, the electromagnet has an outer annular pole face 142 and an inner annular pole face 143, both facing the end wall 24*a* of cup 23 of the tube envelope 20*a*.

The end wall 24*a* includes a plurality of spacedapart ferrous metal segments 132 in a circular array aligned with the outer annular pole face 142 of the electromagnet 140. The end wall 24*a* further includes a ferrous metal ring 133 aligned with the inner annular pole face 143 of the electromagnet 140. These ferrous metal portions of the tube envelope form portions of flux loops from electromagnet 140 for coupling the drive motor 136 to the anode assembly 40, as further described below. It will be appreciated that the tube envelope material adjacent to the ferrous metal segments 132 and the ferrous metal ring 133 must be nonferrous, and may be aluminum or other materials, such as glass or ceramic. However, the use of the ferrous metal portions of the tube envelope as flux carriers permits the tube envelope to be thick and strong without sacrificing the strength of magnetic coupling.

The shaft 138 has a first disc 144 mounted on the end thereof and positioned closely adjacent the end wall 24*a* of the cup 23 extending from the tube envelope 20*a*. The first disc 144 is of a nonferromagnetic material but includes concentric ferromagnetic ring segments 145, 145*a* and 146, 146*a* which are aligned with and closely adjacent the ferromagnetic segments 132 and ring 133 of the tube envelope 20. Ring segments 145 and 145*a* are opposite each other in a circle aligned with the circular array of wall segments 133, the ring segments 145 and 145*a* spanning several of the wall segments 133. The ring segments 146 and 146*a* are also opposite each other and are aligned with ring 133.

A second disc 147 is mounted to the shaft 45 of the rotating anode assembly 40. The second disc 147 has opposed radially extending ferrous metal segments 148 and 149 which may be integral with a central hub 151.

The ferrous metal segments 148 and 149 are separated from each other by nonferrous segments 152 and 153 (see FIG. 9) comprising the remainder of the second disc 147. It will be noted that the ring segments 145, 145*a* and 146, 146*a* of the first disc 14 are coextensive with the ferrous metal segments 148 and 149 of the second disc 147.

Rotation of the anode 50 is accomplished by operating the motor 136 to rotate the first disc 144 and operating the electromagnet 140, wherein the first disc 144 is magnetically coupled or "clutched" to the second disc 147, thereby rotating the second disc 147 and the anode assembly 40 including the anode 50. The ferromagnetic ring segments 145, 145*a* and 146, 146*a* of the disc 144, the ferromagnetic ring 133 and segments 132 of the wall and the ferrous metal portions 148, 149 of the second disc 147 together establish a closed path for magnetic flux between the pole faces 141, 142 of the electromagnetic 140, as indicated by the arrows, to achieve the magnetic coupling.

Speed sensors 154 and 155 are provided for the first disc 144 and the second disc 147, respectively. Fan blades 78 are mounted on the first disc 144 to provide for a flow of cooling air through duct 31.

With reference to FIG. 9, a schematic diagram of speed control means is illustrated. Speed control circuitry 156 receives the output of a speed indicator 157 derived from the speed sensor 155 and a signal generator 158, which indicates the speed of the second disc 147 and the anode 40. A comparator 162 also receives this speed indication. The sensor 154 and signal generator 159 provide an indication of the speed of the first disc 144 to the comparator 162, whereby the comparator determines if the discs are at the same speed, which is also indicative that the discs are magnetically coupled together. The electromagnetic may be turned off and back on to establish coupling if coupling fails initially. This information is provided to the speed control 156, together with the output of a speed selector 163. The speed control 156 adjusts the speed of the variable speed DC motor 136 and operates the electromagnetic 140 as required to achieve the desired speed of anode rotation.

When the X-ray tube 130 is used for radiography only, the clutch 140 may be operated to coupled discs 144, 147 and the motor 136 operated to bring the anode to the desired speed. Alternatively, the motor may bring the first disc 144 to speed, and the clutch may then be operated just prior to the exposure to couple the discs 144, 147 and thereby bring the anode to speed. The speed indicator 157 is useful in permitting exposures as soon as the anode is at the desired speed, and avoiding damage to the tube by applying the anode to cathode voltage before the anode is at a safe speed. Braking of the anode is by slowing or stopping motor 136 with the discs 144, 147 coupled, or a mechanical brake may be employed.

For combined fluoroscopy and radiography, the motor 136 may be operated to rotate disc 144 at the desired speed for radiography, and the electromagnetic 140 may be intermittently operated in pulses to keep tha node at a safe speed for fluoroscopy. The electromagnet 140 is operated continuously just prior to a radiograph in order to bring the anode up to speed. It will be appreciated that the first disc 144 may be brought to the desired anode rpm prior to activating the electromagnetic 140, and that the first disc 144 thereby acts as a flywheel for bringing the rotating anode assembly 40 up to the desired rpm in a short period of time. Alternatively, the discs 144, 147 may be continuously coupled with all speed control via the motor 136.

As an alternative structure, which is not shown but which will be readily appreciated, the electromagnet "clutch" 140 may be mounted to shaft 141 for rotation therewith adjacent the end wall 24*a*, the electromagnet "clutch" 140 replacing the second disc or external rotor 144. In such a configuration, the outer pole of the electromagnet 140 is segmented to match the segmented ferrous portion of the first disc or internal rotor 147. Thus, turning on the rotating electromagnet clutches it to the internal rotor or disc 127, thereby driving the anode.

Figure 10:
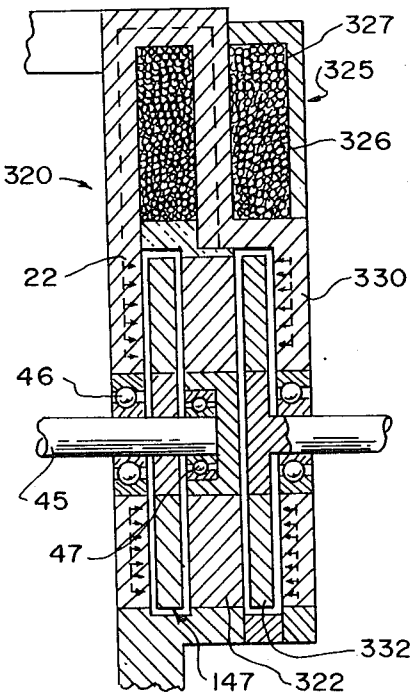
FIG. 10 is a fragmentary sectional view of another X-ray tube according to the invention herein.

With reference to FIG. 10, another X-ray tube 320 is shown in fragmentary section view. The X-ray tube 320 is highly similar to the X-ray tube 130 described above and shown in FIGS. 8 and 9, except that the electromagnet clutch of X-ray tube 320 is mounted to minimize axial loads on the bearings 46, 47 mounting the anode-carrying shaft 145. Accordingly, the electromagnet 325 of the X-ray tube 320 has a radially extending central core 326 about which the coil 327 is wound. The central core 326 extends over the top of one side of the coil and along the end wall of the tube envelope (this portion of the tube envelope is ferrous metal for this purpose) to form one pole piece of the electromagnet 325. Thus, the end wall 22 of the tube envelope lies closely adjacent the internal rotor 147, which in turn, lies closely adjacent a cup end wall 322 having ferrous metal segments similar to that described above. The other end of the core 326 extends juxtaposed the cup end wall 322 to form the other pole piece 330 of electromagnet 325 and a motor-driven external rotor 332 is positioned between the pole piece 330 and the cup end wall 322. The rotor 322 may have a similar configuration of ferrous material as the internal rotor 147. Thus, when the coil of the electromagnet 325 is activated, a flux loop is established passing through the internal rotor 147, the end wall 322 of the tube envelope and the external rotor 332, thereby coupling the internal and external rotors together whereby the anode may be driven, the coupling providing a minimum of axial force on bearings 46 and 47.

Figure 11:
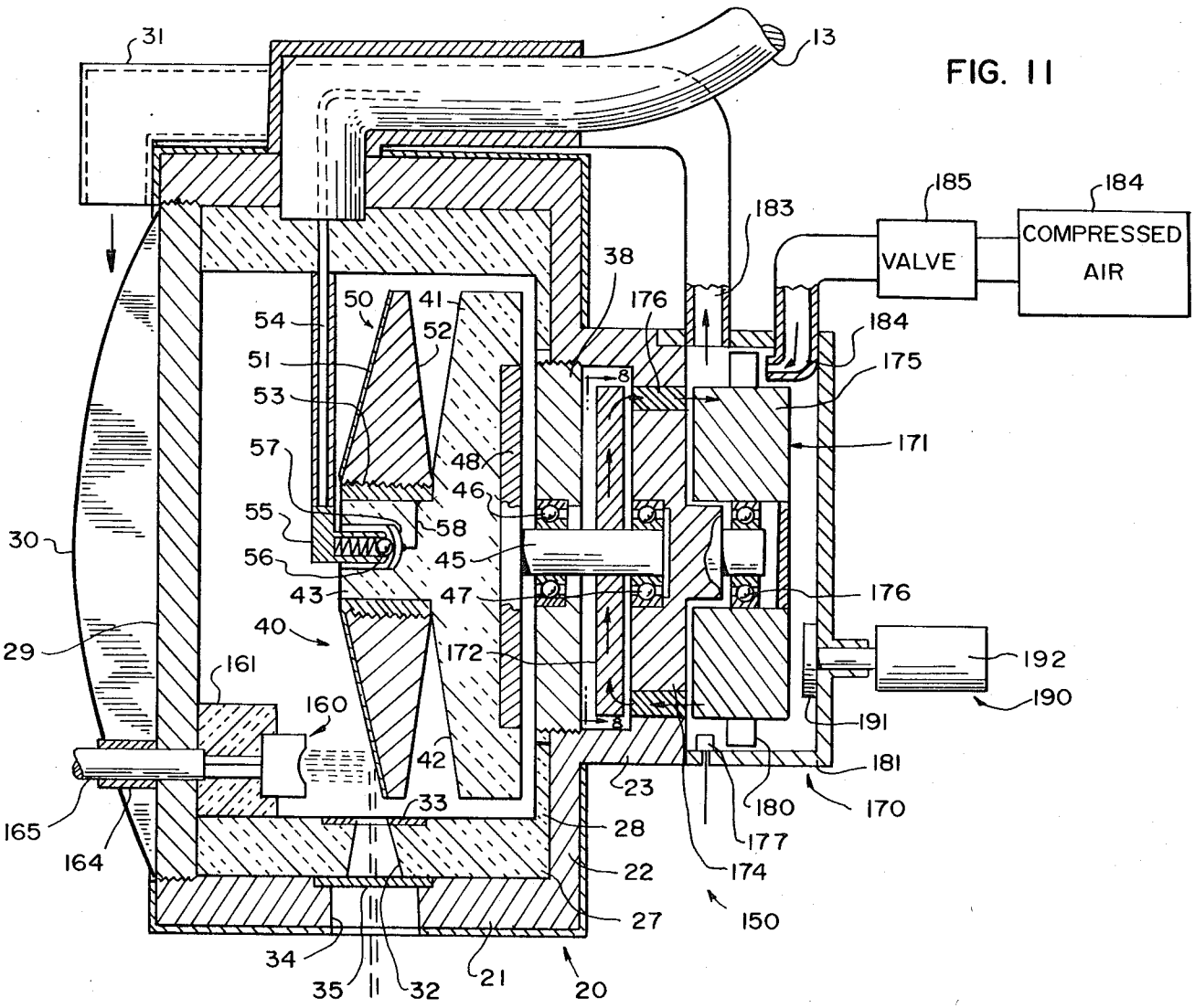
FIG. 11 is a longitudinal sectional view of another X-ray tube according to the invention herein.
Figure 12:
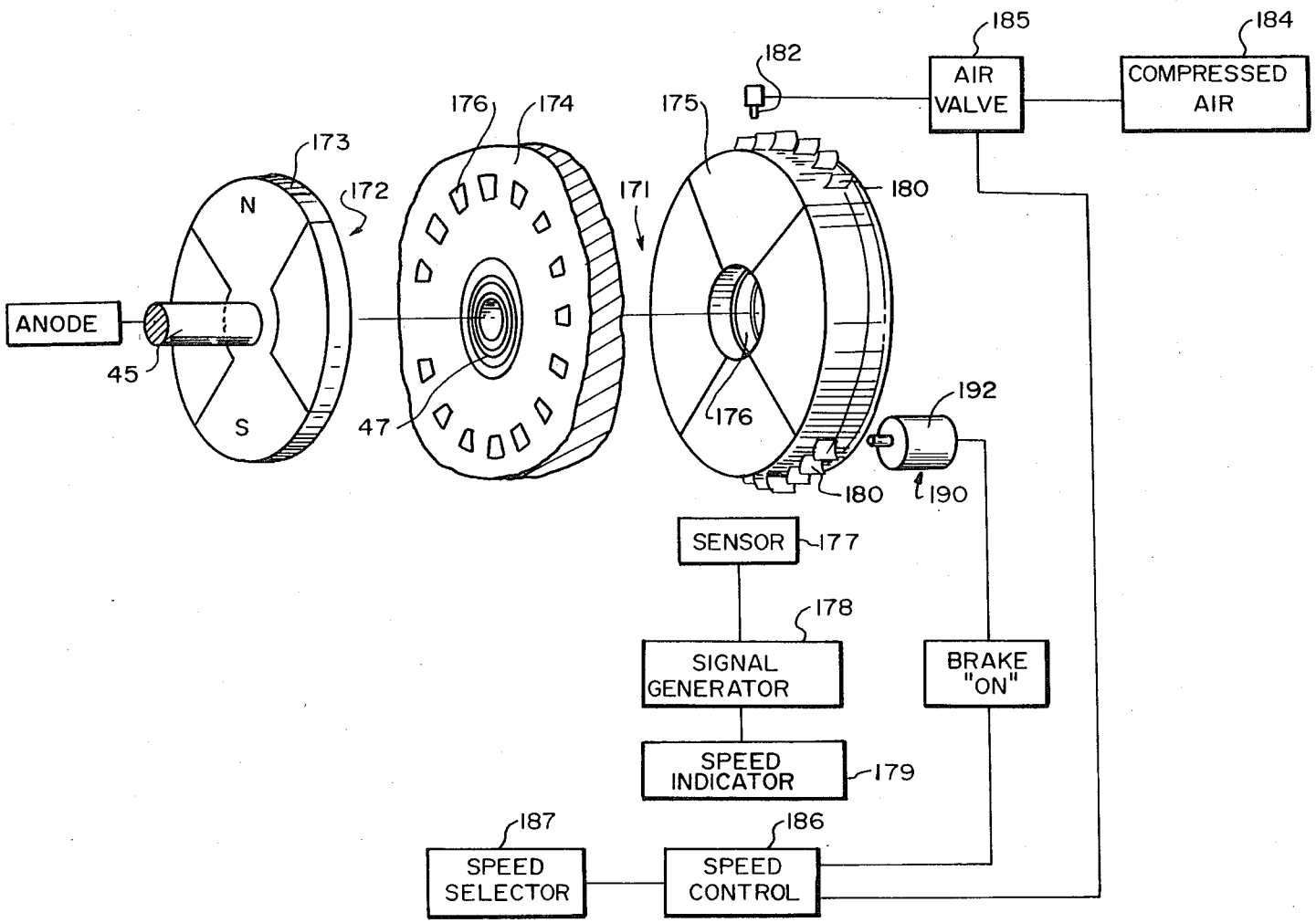
FIG. 12 is an exploded perspective view, partially schematic and partially cut away, of the anode drive of the X-ray tube of FIG. 11.

With reference to FIGS. 11 and 12, another X-ray tube 150 according to the invention herein is illustrated. The X-ray tube 150 generally comprises a tube envelope 20b and a rotating anode assembly 40 including anode 50, which may be substantially the same as in the X-ray tube 10 described above. The X-ray tube 150 differs from the X-ray tube 10 in that the cathode 160 is fixed and is maintained at or near ground potential with the full potential across the anode to cathode gap applied to the anode. THis offers the advantage of simplifying the filament and bias voltage supply circuitry. The X-ray tube 150 further comprises an anode drive 170 characterized by a spinning permanent magnet 175 driven by means of an air turbine 180. X-ray tube 150 is thereby particularly well suited for mobile X-ray apparatus because it is highly compact and lightweight.

More particularly, the anode drive 170 comprises an annular disc 171, including permanent magnet 175, rotatably mounted on bearings 176, which are supported on a stud protruding from the tube envelope 20*b*. The disc 171 is aligned with the disc 172 mounted to shaft 45 of the rotating anode assembly 40, the disc 172 also incorporating a permanent magnet 173 for coupling with the permanent magnet 175. More particularly, the permanent magnet 175 extends diametrically across the disc 171, having diametrically opposed north and south poles. The permanent magnet 173 is similarly shaped, so that the magnets 173 and 175 align with each other with northsouth pole attraction. The remaining portions of discs 172, 173 are nonferrous.

The permanent magnets 173 and 175 are coupled together through the end wall 174 of cup 23 of the tube envelope **20*b*. To enhance the coupling, the end wall 174 is provided with a circular array of spaced-apart ferrous segments 176, the tube envelope material between and around the segments 176 being nonferrous. Thus, the magnetic flux coupling the magnets 173, 175 together passes through the segments 176. This permits the end wall 174 to be thick and strong, and minimizes air gaps in the flux path for maximum coupling strength. The ferrous segments 176** must be spaced apart to avoid establishing noncoupling flux loops between the poles of the magnets.

The disc 171 is surrounded by a casing 181 having an air inlet 182 and an air outlet 183. The air turbine 180 comprises a plurality of turbine vanes mounted to the periphery of the disc 171, and compressed air from supply 184 is admitted to the air inlet 182 by air valve 185, enters the casing 181, flows through the air turbine 180 and departs the casing 181 at the air outlet 183. The air inlet 182 is preferably in the form of a plurality of air nozzles acting on the blades 180, which achieves fast acceleration. Air from the outlet 182 is conducted through duct 31 mounted to the exterior of the tube envelope **20*b* and directed over the cooling fins 30**.

Thus, the compressed air rotates the permanent magnet 175, and valve 185 is preferably a variable position valve whereby the speed of rotation is controlled by the position of the valve 185. More particularly, a speed sensor 177 and signal generator 178 drive a speed indicator 179 which inputs to a speed control 186, the speed control 186 also receiving the output of a speed selector 187. The speed control operates the air valve 185 to achieve the desired speed of rotation. A brake assembly 190 comprising a brake shoe 191 biased against the disc 171 by a solenoid 192 brings the rotating anode back to low speed or a stop following an exposure.

The cathode 160 of X-ray tube 150 is mounted on a ceramic insulator 161 projecting into the interior of the tube envelope **20*b* and supporting the cathode the desired distance from the rotating anode. The cathode 160 may be provided with two fixed filaments, not shown in FIG. 8. The cathode 160 is carried at or near ground potential, and the full positive potential of the tube is applied to the anode through the anode cable 13. The cathode cable, including the filament supply leads, may then be of lighter duty, and a cathode cable 165 is shown entering the tube envelope at a terminal 164 mounted to the end wall 29 with the conductors carried through the ceramic insulator 161 to the cathode 160**.

Figure 13:
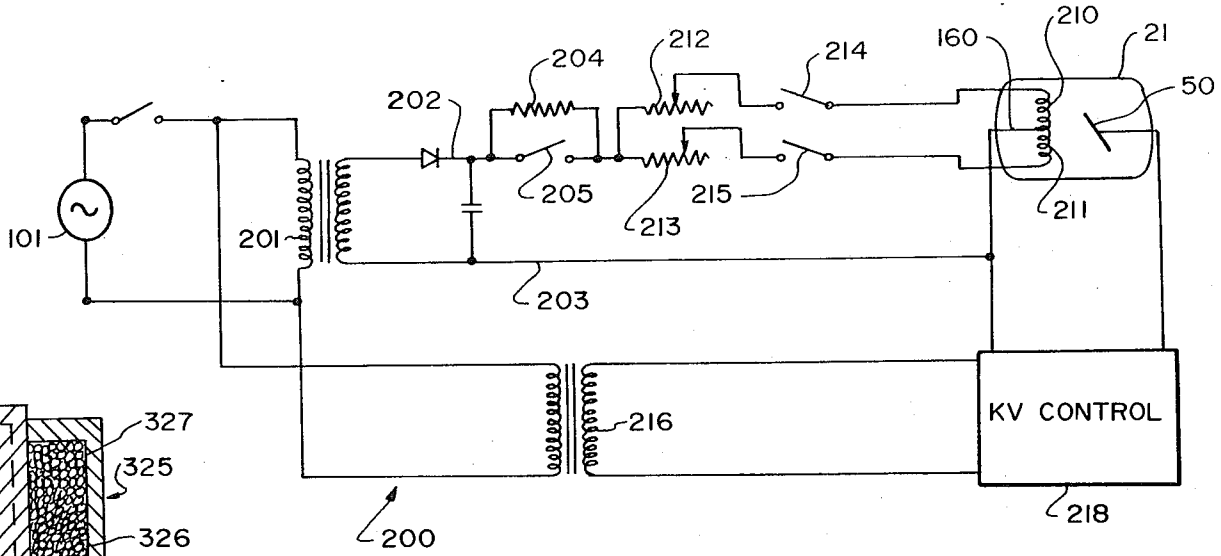
FIG. 13 is a schematic diagram of a circuit for operating the X-ray tube of FIG. 11.

With reference to FIG. 13, a schematic diagram of a circuit 200 for the X-ray tube 150 is shown. A transformer 201 and recitifier circuit provide a DC voltage across leads 202 and 203. Current is supplied to the two cathode filaments 210 and 211 through variable resistors 212 and 213, respectively, and switches 214 and 215 control which filament is selected. A small current may be provided to preheat the selected filament through a resistor 204, and a "prep" switch 205 is closed to short out resistor 205 and provide full filament current. It will be noted that no transformer is required to supply the filaments 210 and 211 (or for the grid supply, not shown) which considerably simplifies the support apparatus for the X-ray tube 150. The circuit 200 further comprises a transformer 216 supplying a KV control 218, which provides the anode to cathode (ground) potential.

Figures 14, 15:
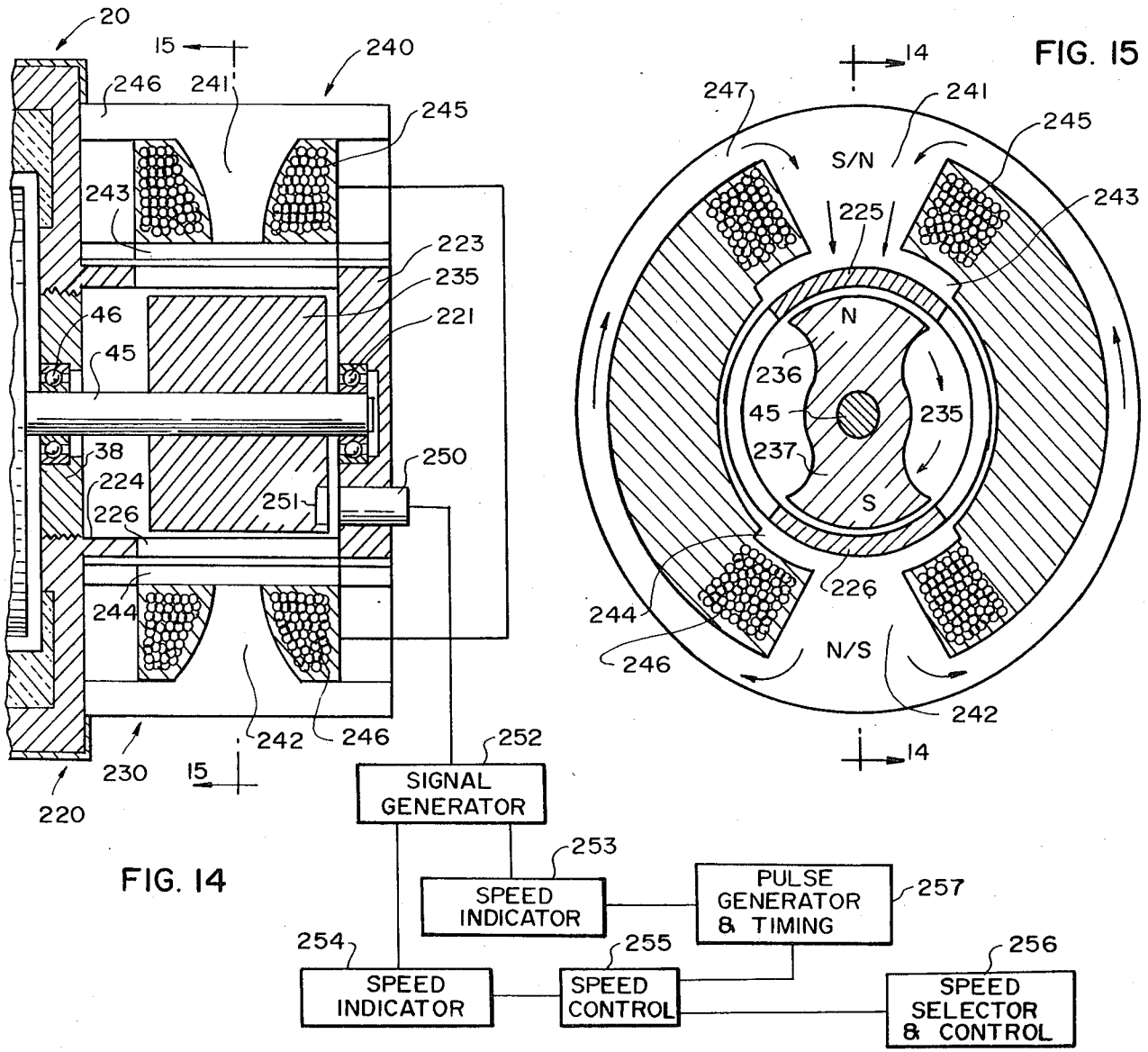
FIG. 14 is a longitudinal sectional view, partially cut away, of another X-ray tube according to the invention herein.
FIG. 15 is a sectional view of the X-ray tube of FIG. 14 taken along the lines 15—15 of FIG. 14.

With reference to FIGS. 14 and 15, another X-ray tube 220 according to the invention herein is shown. More particularly, in FIG. 14, the anode drive 230 for the X-ray tube 220 is shown, and the remaining portions of the X-ray tube 220 including the cathode, anode assembly, remainder of the tube envelope, etc. may be the same as any of the previously described X-ray tubes.

In FIG. 14, the shaft 45 of the anode assembly is supported in and extends through bearings 46 which are mounted in the disc 38 of the tube envelope 20. The shaft 45 is also mounted in bearings 221 set in the end wall of cup 223 extending from the tube envelope 20.

The anode drive 230 is characterized by a permanent magnet rotor 235 which is driven by a stationary external DC stator 240 coupled to the rotor through the cylindrical wall 224 of the cup 223. The permanent magnet rotor 235 is mounted to shaft 45 and is positioned in the cup 223. The north pole 236 and the south pole 237 of the permanent magnet rotor 235 are diametrically opposed and lie closely adjacent the interior of the cylindrical wall 224, with a minimum air gap therebetween. The stator 240 surrounds the cylindrical wall 224, and has diametrically opposed ferrous pole pieces 241 and 242 having pole shoes 243 and 244, respectively, lying closely adjacent the exterior of the cylindrical wall 224. The pole pieces 241 and 242 have coils 245 and 246, respectively, wound thereabout for creating a magnetic field which drives the permanent magnet rotor 235. The pole pieces 241 and 242 are connected by a ferrous cylindrical outer wall 247, which provides a flux path connecting the pole pieces.

The cylindrical wall 224 of the tube envelope cup 223 including ferrous segments 225 and 226, the ferrous segment 225 lying adjacent the pole shoe 243 of the pole 241 and the ferrous segment 226 lying adjacent the pole shoe 244 of the pole 242. The other portions of the cylindrical wall 224 are nonferrous, and may be aluminum or preferably glass. It should be noted that the pole shoes 243 and 244, the ferrous wall segments 235 and 226 and the permanent magnet rotor ends 236 and 237 are of the same size and particularly the same width, whereby they are coterminus when aligned, as shown in FIG. 12.

The rotor 235 is driven by energizing the coils 245 and 246, respectively, surrounding the pole pieces 241 and 242, thereby establishing a magnetic field which repulses or attracts the rotor 235 depending upon its position and the direction of the magnetic field, as is well known in motor technology. For instance, with reference to FIG. 15, the rotor 235 is shown rotating in a clockwise direction, and the coils 245 and 246 are energized to establish pole piece 241 as a north pole and pole piece 242 as a south pole. Thus, the north pole 236 of the rotor is repelled from the pole ppiece 241 of the stator, and the south pole 237 is also repelled from the pole piece 242 of the stator, continuing to drive the rotor in the clockwise direction. As the rotor completes 180° of rotation, the direction of the current in coils 245 and 246 is reversed to continue to drive the rotor and hence the anode via shaft 45.

A sensor 250 mounted through the end wall of the cup 223 determines the passage of a passive sensor target 251 mounted to the rotor 235. The sensor may be a magnetic sensor, an optical and particularly a fiber optical sensor, or even a mechanical sensor, as desired. The output of the sensor 250 is processed through a signal generator 252, which signals a position indicator 253 and a speed indicator 254. Speed control circuitry 255 receives the output of a speed selector and control 256 as well as the output from the speed indicator 254 and, in conjunction with pulse generator and timing circuitry 257, receiving the output of the position indicator 253, provides appropriate pulses for energizing the coils 245 and 246 to drive the rotor 235 and hence the anode. The pulses are timed with respect to the rotation of the rotor such that maximum torque is exerted until the rotor and anode are at the desired speed, and then sufficient driving force is provided to maintain that speed. Braking is accomplished by appropriate reversing of the fields to slow and stop the rotor. An external cooling fan (not shown) may be provided with the X-ray tube 220, inasmuch as there are no moving external parts for creating a flow of cooling air. It will be appreciated that the rotor 235 may have multiple pole pieces and the stator may also have multiple pole pieces, whereby the strength of the drive is increased. The embodiment shown has two pole pieces for sake of simplicity.

Figure 16:
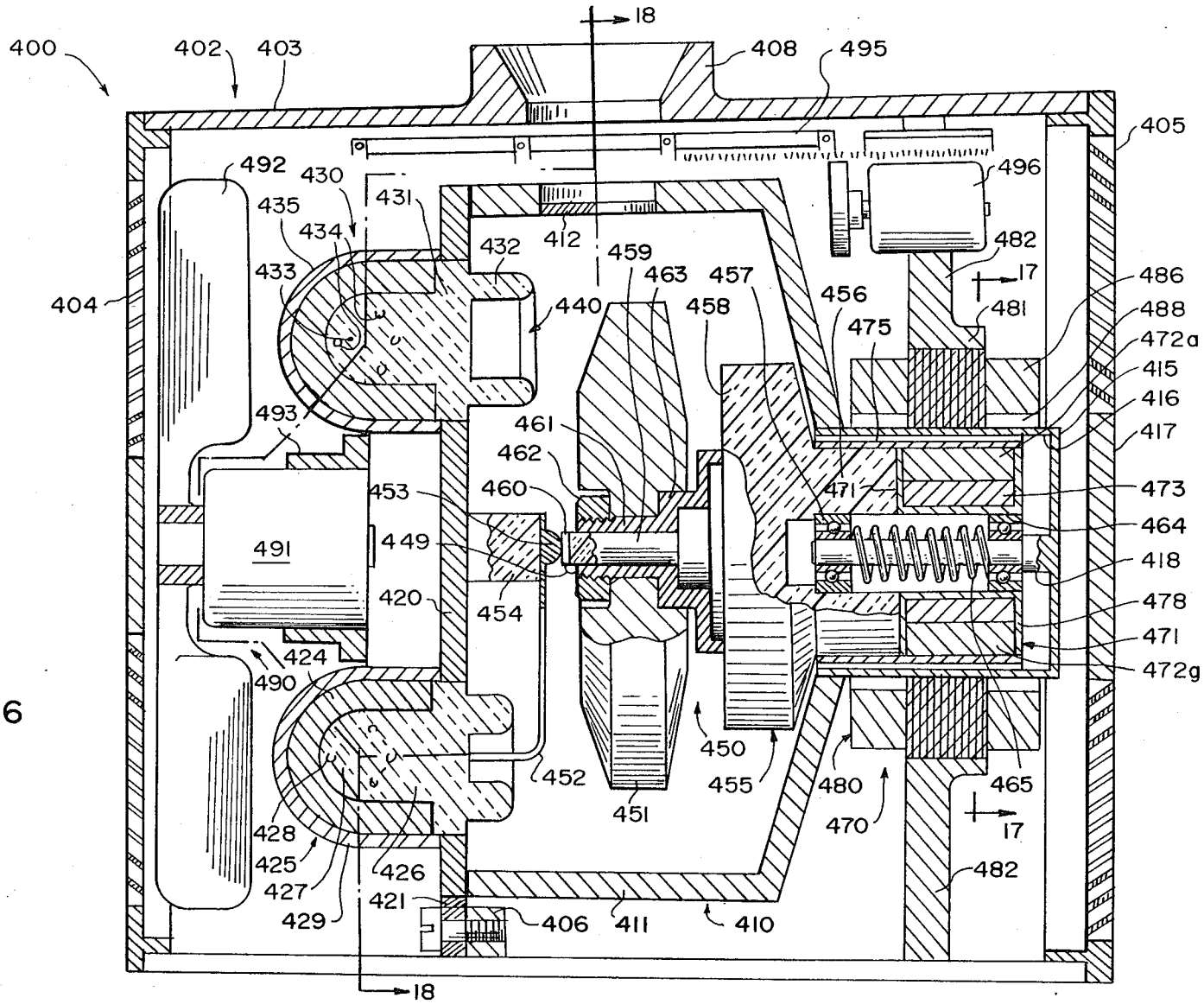
FIG. 16 is a longitudinal sectional view of another X-ray tube according to the invention herein.
Figure 18:
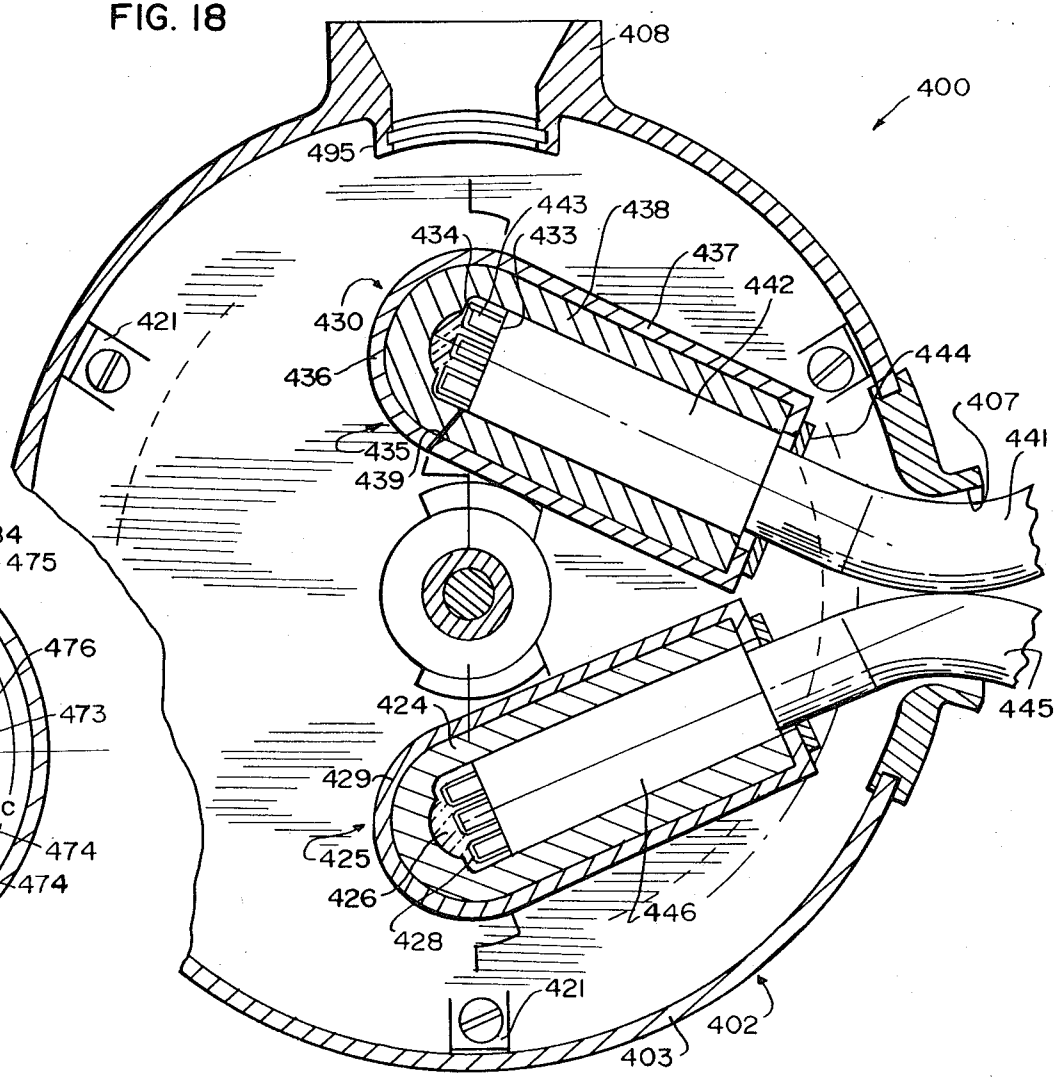
FIG. 18 is a sectional view of the X-ray tube of FIG. 16, taken along the lines 18—18 of FIG. 16.
Figure 17:
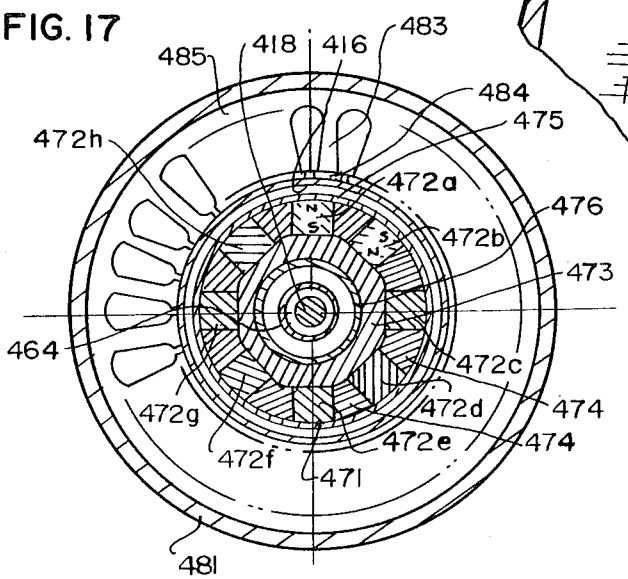
FIG. 17 is a sectional view of the motor drive of the X-ray tube of FIG. 16, taken along the lines 17—17 of FIG. 16.

A further and preferred embodiment of the invention herein is found in the X-ray tube 400 of FIGS. 16–18. The X-ray tube 400 generally comprises a tube envelope 410 having an anode assemlby 450 rotationally mounted therein, the anode assembly including an anode 451 and the rotor portion of a motor drive 470. The tube envelope 410 is received in a housing 402, which mounts the stator of the motor drive. The tube envelope includes cable terminations, and is cooled by a fan which circulates air through the housing surrounding the tube envelope.

The tube envelope 410 includes a cylindrical sidewall 411 surrounding the anode, and is provided with a radiolucent window 412 for emitting the X-rays. An annular end wall 413 joins the sidewall 411 with a cup 415. The cup 415 protrudes outwardly and includes its cylindrical sidewall 416 and an end wall 417. An axially-disposed stud 418 protrudes from the end wall 417 into the interior of the tube envelope for supporting the rotating anode assembly 450, as more fully discussed below. The opposite end of the tube envelope 410 is closed by an end wall 420 secured to the cylindrical sidewall 411 of the tube envelope, which mounts terminals 425 and 430, more fully discussed below. The sidewall 411 and end wall 420 are preferably fabricated of copper, and the cup 415 is preferably fabricated of 304 steel, Monel steel or other similar non-ferromagnetic steel.

The anode assembly 450 is rotationally mounted in the tube envelope 410 on the stud 418 of the cup 415. the anode assembly 450 generally comprises the anode 451, a ceramic insulator 455, and the rotor 471 of the motor drive 470 for the rotating anode assembly. The insulator, which is fabricated of ceramic, includes a cylindrical shank 456 which extends into the cup 415 of the tube envelope. Thus, the shank surrounds the stud 418, and a bearing 457 is provided between the stud and interior of the shank. The ceramic insulator 455 further comprises a disc 458 which extends radially outwardly from the shank along the tube envelope end wall 413, and shields the interior of the cup 415 from radiant heat transfer from the anode. A stud 459, which may be stepped as shown, extends from the disc 458 opposite the shank 456, and has a metal contact and bearing plate 460 mounted at its free end. A metal sleeve 461 is fitted around and secured to the stud 459, and the anode 451 is slipped over the metal sleeve and secured by a nut 462. A portion of the metal sleeve 461, indicated at 463, forms a key which engages with a slot in the anode 451 to ensure rotation of the anode with the ceramic insulator 455.

The motor drive 470 is characterized by a rotor 471 incorporating a plurality of permanent magnets, preferably of the rare earth type, which results in a motor drive capable of high torque despite the gap extant between the stator and the rotor. The rotor structure seals the rare earth magnets to prevent them from contaminating the evacuated interior of the tube envelope 410.

More particularly, the rotor 471 comprises eight generally rectilinear rare earth permanent magnets **472*a*–472*h*, deployed spaced apart and extending outwardly from an octagonal steel ring 473, which serves to close the flux loop between the magnets. As best seen in FIG. 17, the permanent magnets 472 are separated by spacers of non-ferrous material 474. A casing of non-ferrous material surrounds and encloses the permanent magnets, the casing including an outer sleeve 475 which extends over and is secured to the shank 456 of the ceramic insulator by brazing or the like to mount the rotor 471 thereto. The casing further includes an inner sleeve 476 concentric with the stud 418. End walls 477 and 478 connect the inner and outer sleeves to complete the encapsulation of the permanent magnets and steel ring. The outer surface of the steel ring is octagonal, whereby the eight permanent magnets 472*a*–472*h* lie flat against the eight outwardly facing surfaces of the steel ring. The permanent magnets are deployed with alternating polarities, e.g, permanent magnet 472*a* has its north pole on its outer surface and its south pole adjacent the steel ring, and permanent magnet 472*b*** has its north pole adjacent the steel ring and its south pole on its outer surface.

The rotor 471 may be fabricated by a copper cast process, and in particular, the steel ring 473 and the magnets may be placed in a form of mold into which liquid copper is poured to form the end walls 477 and 478, spacers 474, and inner casing sleeve 476. This subassembly may be milled to round the outer surfaces of the magnets and spacers, and the diameter of the inner casing sleeve may be finished to desired tolerances. The resulting subassembly may be dropped into the outer casing sleeve 475, and appropriate welding or brazing is carried out to seal the structure and encapsulate the permanent magnets. The extending portion of the outer sleeve is brazed to the shank of the ceramic insulator to mount the rotor thereto. Alternatively, the magnets can be pre-rounded on their outer surfaces, and the entire casing and spacers can be cast in one operation. As a further alternative, the spacers can be fabricated in pieces, and the rotor structure can be fabricated from welding up end walls and sleeves to encapsulate the steel ring, magnets and spacers. In short, there are several ways of making the sealed rotor, and the primary characteristic is that the permanent magnets are encapsulated so as not to contaminate the evacuated interior of the X-ray tube envelope.

A second bearing 464 is mounted between the interior of the rotor and the stud 418, and the two spaced apart bearings serve to rotationally mount the anode assembly 450. It will be noted that the second bearing butts against a shoulder of the stud 418, the first bearing butts against a shoulder of the opening in the shank of the ceramic insulator, and a spring 465 is placed between the two bearings. This arrangement biases the rotating anode assembly away from the cup end of the tube, and structurally "grounds" it as further discussed below.

The stator 480 of the motor drive 470 for the X-ray tube 400 surrounds the cup 415 of the tube envelope 410. The stator itself is mounted in a ring 481 supported on struts 482 extending from the housing 402. The cup 415 of the tube envelope slides in and out of the stator for replacing the tube envelope, and the stator supports and positions the tube envelope within the housing.

With particular reference to FIG. 17, the stator 480 comprises a plurality of pole pieces 483 terminating in pole shoes 484 which surround the cylindrical sidewall 416 of the cup 415. The pole pieces are connected at the outer portion of the stator by a ring. The space between the cores accommodate the windings, not shown in detail but shown generally at 486 in FIG. 16. The stator is preferably comprised of a stack of laminations, as also indicated in FIG. 16, which reduces eddy currents in the stator. Winding is accomplished in accordance with known motor technology, given the specific number of magnets and number of pole pieces. In the embodiment shown, there are twenty-four pole pieces and eight magnets, but it will be appreciated that a different number of both pole pieces and magnets could be utilized and with the stator wound accordingly.

A Hall device 488 is mounted on the exterior of the cup wall 316 adjacent the stator 480. It will be noted that the permanent magnets 472 have an axial length greater than that of the pole shoes, and thereby extend beyond the pole pieces. This allows the Hall device to be positioned adjacent the pole pieces and be activated by the permanent magnets as the rotor rotates, and also biases the rotating anode assembly away from the cup end of the tube envelope toward a structural stop.

It should be noted that the gap between the cup wall 416 and the exterior of the rotor is exaggerated in FIG. 17 for purposes of clarity. The motor drive is quite strong and capable of producing high torque for quick starts. Although a specific motor control is not shown, it can be similar to that described above with respect to X-ray tube 220, with the Hall device providing switching signals.

The X-ray tube 400 further comprises a cathode 440 mounted to the end wall 420 opposite the anode 451, and receiving its power via cable 441 through terminal 430. Terminal 430 comprises a feedthrough formed of insulating material in the form of a ceramic or glass stud 431 sealed to and extending through the end plate 420 of the tube envelope. The ceramic stud 431 has a cup portion 432 extending into the tube, and which mounts one or more filaments and the grid comprising the cathode 440 of the X-ray tube 400. With reference to FIGS. 16 and 18, the outside end of the ceramic or glass stud 431 has a flat, sideways facing surface 433 in which plug receptacles 434 are fitted. Wires are embedded in the stud to connect the plug receptacles with the filaments and grid, as appropriate. A metal shield 435 is secured to the end plate 420 and has a curved closed end portion 436 generally surrounding the protruding the stud and an elongated portion 437, U-shaped in section, extending along the end plate 420. Plastic insulation 438 is positioned between the metal shield 435 and stud 431, and defines an opening therein for receiving the terminal end 442 of the cathode supply cable 441. The terminal end 442 of the cathode supply cable has a plurality of plugs 443, such that it may be inserted into the opening in the plastic insulation 438 and plugged into the plug receptacles 434 on the stud 431. The terminal end 442 is shaped for this purpose, and includes a flange 444 which may be secured to the metal shield for retaining the cable. A narrow air channel 439 is provided from the interface of the cable terminal end and the stud, the air channel 439 leading through the plastic insulation and metal shield, such that air may be pushed out of the opening in the plastic cover as the cable's terminal end is inserted.

The anode supply cable 445 is terminated at the tube envelope in a similar manner. The terminal 425 also comprise a ceramic or glass stud 426 extending through and sealed to the end plate 420, the stud 426 having a flat, sideways facing surface 427 in which plug receptacles 428 are formed. A metal shield 429 is secured to the end plate 420, and has a plastic insulation 424 fitted therein for receiving a terminal end 446 of the anode supply cable 445, which plugs into the plug receptacles 428. The plug receptacles 428 are connected to a wire lead 452 which extends into the X-ray tube envelope and has a end terminal 453 supported on a ceramic stud 454 mounted to the end plate and extending toward the anode, with the metal plate 460 on the rotating anode assembly in contact therewith. A wire lead 449 from the metal plate to the metal sleeve 461 completes the electrical circuit to the rotating anode.

It will be noted that the rotating anode assembly 450 is biased against the terminal 453 supported by the ceramic stud 454, which thereby axially positions the anode 451 within the tube envelope. This is advantageous and in that anode and cathode both have their reference position with respect to the end plate 420, and the distance between the cathode and anode remains constant within close tolerances despite heat expansion of the tube envelope.

The entire tube envelope 410 is mounted in the housing 402, which basically comprises a cylindrical outer wall 403 and end covers 404 and 405. The tube envelope is supported within the hosuing by sliding the end cup 415 within the stator 480 which in turn is mounted to the cylindrical wall of the tube housing by struts 482. At the terminal end of the tube envelope several lugs 421 extend radially outwardly and are fastened to complementary positioned lugs 406 extending from the tube housing, as best seen in FIG. 18. The housing wall 403 is slotted at 407 (FIG. 18) to accommodate the anode and cathode supply cables 441 and 445.

A fan assembly 490, including a fan motor 491 driving fan blades 492, is mounted within the tube housing for air cooling the X-ray tube 400. The fan assembly is preferably mounted at the cathode end of the tube, and in the preferred embodiment shown a bracket 493 is provided extending from the terminal shields 429 and 435 for supporting the fan motor. The end covers 404 and 405 at the ends of the tube housing are slotted to provide air flow. When the fan is operated, it blows on the end wall 420 and pushes air along the sides of the tube envelope and out the opposite end of the housing. End wall 420 can be provided with cooling fins, if desired.

The tube housing sidewall 403 is provided with a collimater 408 which is in registration with the window opening 412 of the tube envelope for emitting the X-rays. It is convenient to mount a sliding filter 495 powered by a motor 496 within the tube housing adjacent the tube envelope wherein the filter is slidably adjustably positoned over the window opening 412. The cylindrical tube housing is readily adaptable to the trunnion mounts generally used in X-ray tube equipment.

The X-ray tube 400 operates in the usual manner, i.e. a high voltage potential is applied to the anode 451 via the anode cable 445, anode terminal 425, lead wire 452 and terminal 453. The cathode is heated and grid voltage applied, and the motor drive 470 is operated to rotate the anode while X-rays are being produced. It will be appreciated that the copper tube envelope acts as an effective shield for stray X-rays, and also has excellent heat conductivity for transferring the heat from the interior to the exterior of the tube. The fan assembly provides cooling air to maintain the tube in a relatively cool condition during operation. The ceramic insulator 455, and particularly the cylindrical disc portion 458 thereof, helps to maintain the temperature in the cup 415 at relatively low level. Thus, the rare earth magnets of the rotor 471 are able to maintain their magnetic properties over a substantial period of time.

With reference to FIGS. 19–22, another X-ray tube 500 according to the invention herein is illustrated. The X-ray tube 500 is characterized by the use of rotating field induction motor drive, commonly referred to as the squirrel cage motor drive, operating through a laminated segmented portion of the tube envelope wall disposed between the stator and rotor. A further feature of the X-ray tube 500 is a cam activated Hall device speed monitor, which can be used in a feedback mode to control the motor speed. Figures 19–22 are fragmentary views of the X-ray tube 500, illustrating the cup portion 520 of tube envelope 510, a portion of the rotating anode assembly 540 including the rotor 550 of the motor drive, and the stator 570 of the motor drive surrounding the cup 520. It will be appreciated that the remaining elements of the X-ray tube 500 may be the same as those found in the X-ray tube 400 described above, and that the motor drive of the X-ray tube 500 can also be used with other configurations of X-ray tubes described above in place of the specific motor drives disclosed in connection therewith.

The end cup 520 of the X-ray tube 500 comprises a cylindrical sidewall 525, an end plate 535, and a stud 538 for mounting the rotating anode assembly 540. The cylindrical sidewall 525 of the cup has a plurality of laminated ferrous segments **526*a*–526*f* disposed between the rotor and stator of the motor drive, the segments extending axially along the wall in the area between the rotor and the stator and being interrupted along the circumference of the cylindrical wall by narrow non-ferrous segments 530, best seen in FIG. 20. The stator 570, comprising pole pieces 571 and pole shoes 572, surrounds the cup 520, whereby the ferrous segments 526*a*–526*f* in effect become extensions of the pole shoes 572 of the stator 570**, thereby reducing the effective gap between the stator and the rotor. The gap is exaggerated in the drawings for purposes of clarity, and is actually on the order of 0.005 inch.

The segments **526*a*–526*f* are preferably laminated to reduce eddy current effects; however, the laminated segments are not vacuum tight. Therefore the cylindrical wall of the cup further comprises a thin non-ferrous cylindrical sleeve 528** which prevents loss of vacuum through the laminated segments.

With reference to FIGS. 23 and 24, a process for making the end cup 520 with its laminated segments is illustrated. A plurality of annular laminations 524 are fabricated, including spaced apart openings 523. At this point, the laminations are of greater diameter than the diameter of the finished wall, and correspond to the lower right hand portion of FIG. 24. A cylindrical cup portion 521 is provided with openings positioned correspondingly to the openings in the laminations, and non-ferrous pins 530 are inserted into these openings. The laminations are inserted over the pins, and a second portion 522 of the cup comprising the end wall and stud and a portion of the cylindrical sidewall is press fit on to the pins, thereby sandwiching the laminations between the two solid portions of the cup. As schematically shown in FIG. 24, the partially completed cup is milled to a lesser diameter, exposing the non-ferrous pins on the exterior surface. It will be noted that the pins were already exposed on the interior surface by virtue of the position of the openings in the laminations. Thus, the annular laminations are separated into the laminations ferrous segments **526*a*–526*f* between the non-ferrous pins 530**.

The rotor 550 is mounted to the end of a ceramic insulator 545 of the rotating anode assembly, generally opposite the anode (not shown) and is positioned within the cup 520 surrounded by the stator 570. The rotor 550 comprises a stack of ferrous laminations 551 which, in their outer portions, have longitudinal openings filled with non-ferrous material indicated at 522, in typical squirrel cage configuration. Again, laminations are used to reduce eddy currents; however, it is difficult to completely clean the laminations and, therefore, the laminations of the rotor are sealed in a casing 555 to prevent contamination of the tube envelope. More particularly, the laminations are encased by a cylindrical outer sleeve 556, a cylindrical inner sleeve 557 and end walls 558 and 559, with the cylindrical outer sleeve extending over a portion of the shank 546 of the ceramic insulator 545 to attach the rotor thereto. The rotor is formed by copper casting the non-ferrous bars 552 and casing 555, which also permits providing a good mechanical connection to the shank 546 of the ceramic insulator. As seen in FIG. 22, the shank 546 of the insulator is formed with flat surfaces 547 and a circumferential groove 548. Thus, when the outer sleeve 556 is copper cast, the copper mates with the flats and grooves of the shank for securely attaching the rotor in both axial and rotational modes.

Figure 19:
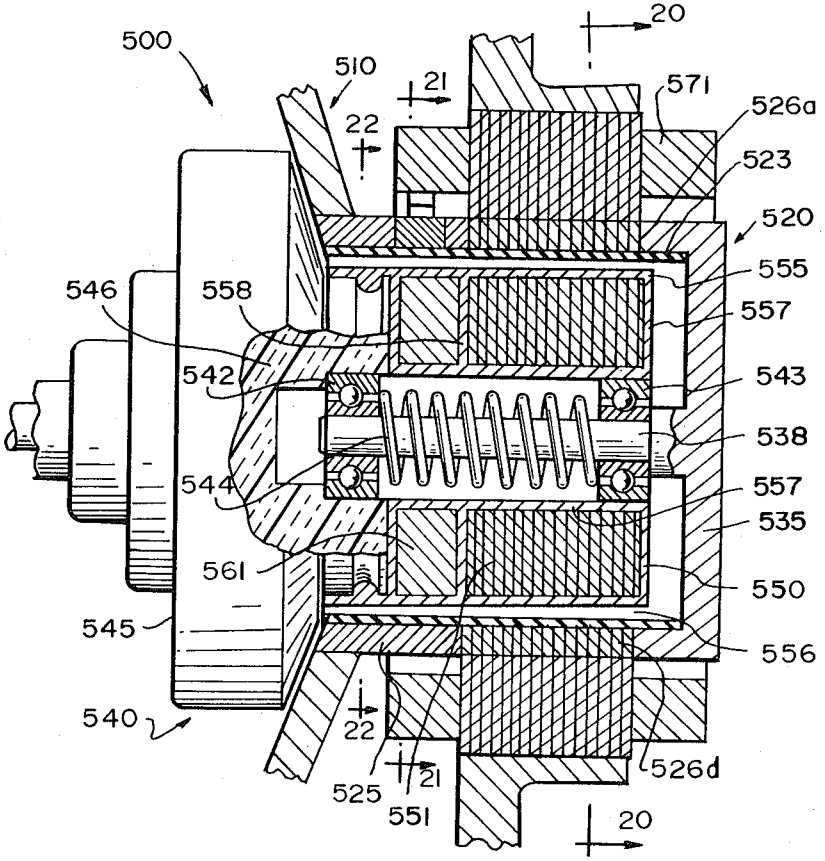
FIG. 19 is a fragmented longitudinal sectional view of another X-ray tube according to the invention herein, particularly the motor drive portion thereof.
Figure 20:
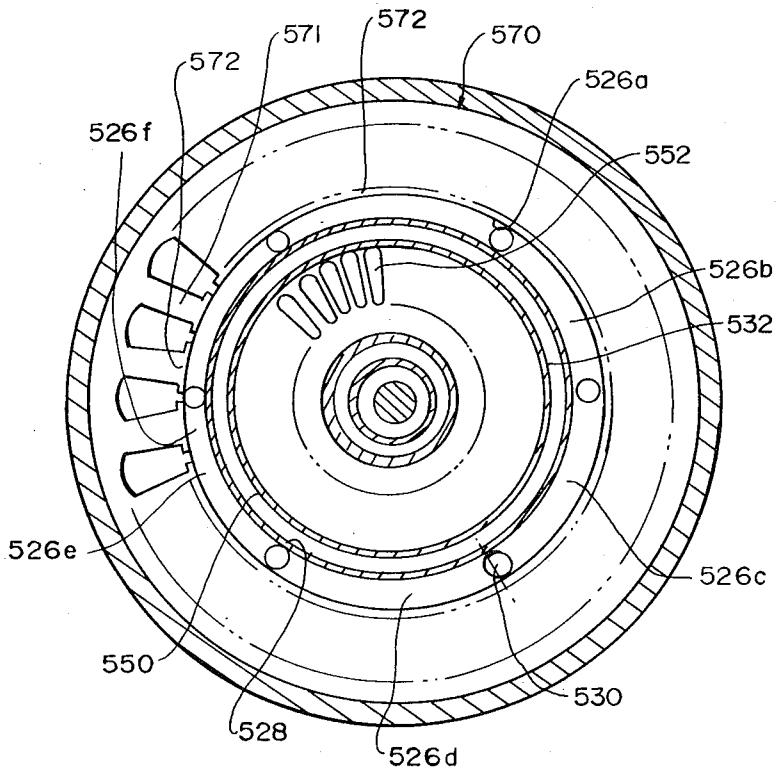
FIG. 20 is a sectional view of the motor drive portion of the X-ray tube of FIG. 19, taken along the lines 20—20 of FIG. 19.

The rotor also incorporates a cam 561, best seen in FIGS. 19 and 21, which forms a part of a speed monitoring assembly 560 of the X-ray tube 500. The speed monitoring assembly 560 also comprises two spaced-apart ferrous segments 562 and 563 extending through the cylindrical wall 525 of the cup 520 (although they do not extend through the inner sleeve 528). A magnet 564 is positioned over one of the segments, and a Hall device 565 is positioned over the other, with a ferrous bar 566 bridging the magnet and Hall device. The cam 561 has ferrous lobes 568 which, when they pass the ferrous segments 562 and 563, close a flux loop through the Hall device 565. Thus, the signals from the Hall device indicate the speed at which the anode is rotating. The cam 561 is conveniently positioned adjacent the rotor, and may be incorporated into the rotating anode assembly structure by copper casting it with the rotor. It will be appreciated that the cam may comprise any ferrous element mounted on or near the exterior of the rotating anode assembly and positioned and sized to make and break the flux loop through the Hall device.

The rotating anode assembly 540 is mounted on stud 538 by bearings 542 and 543 and is biased toward the cathode end of the tube by spring 544, similar to the description above with respect to X-ray tube 400.

The stator 570 of the motor drive is as described above, and has windings 571 in accordance with known motor technology, e.g. it can be wound for two or three-phase operation. The motor drive can be run from AC current at standard frequencies, but is preferably powered by a variable frequency motor control, not a part of the invention herein.

The X-ray tube 500 can be efficiently driven, primarily because of the small effective gap between the stator and rotor, achieved through the use of the segmented wall.

It will be appreciated that the X-ray tubes illustrated and described herein are preferred embodiments and that changes may be made by those skilled in the art without departing from the spirit and scope of the invention. As a very basic example, the various drive means may be used in combination with the rotating cathode feature or with the fixed grounded cathode feature, or even with tube envelopes of prior art X-ray tubes which have been appropriately modified to accept the drive means according to the invention herein. Similarly, structural changes in the tube envelopes illustrated, terminals, bearing positions, and the like, may also be made. Accordingly, the invention herein is limited only by the following claims.

I claim:

1. An X-ray tube comprising:

(A) an evacuated tube envelope having a window for passing X-rays from the interior thereof;

(B) a cathode mounted in the tube envelope;

(C) an anode rotatably mounted in the tube envelope;

(D) DC motor anode drive means for rotating the anode during operation of the X-ray tube, including (1) an internal rotor mounted within the tube envelope and coupled to the anode, to rotate the anode, the internal rotor comprising at least one permanent magnet having at least two poles (2) a multiple pole DC stator positioned on the exterior of the tube envelope and having a number of pole pieces equal to or greater than the number of poles of the permanent magnet of the internal rotor and (3) electrical means for supplying electrical DC power to the stator to create a magnetic field for driving the internal rotor; and (E) electrical means connected to the anode and cathode for producing X-rays during rotation of the internal rotor.

2. An X-ray tube as defined in claim 1 wherein the tube envelope is fabricated of non-ferrous metal.

3. An X-ray tube as defined in claim 1 together with a housing enclosing the tube envelope and wherein the tube envelope is fabricated of metal and is mounted in the housing to provide an annular space and together with a fan mounted on the housing to cause a flow of air through the annular space for cooling the tube envelope.

4. An x-ray tube as defined inclaim 1 wherein the permanent magnet is a rare earth magnet encapsulated in a casing so that the rare earth magnet will not contaminate the interior of the evacuated tube envelope.

5. An x-ray tube as defined in claim 1 wherein said electrical means includes means for producing pulses and further comprising a sensor for sensing the position and/or speed of the rotating anode for controlling the timing of the pulses supplied to the stator for controlling the speed at which the anode rotates and/or to confirm anode rotation at the desired speed.

6. An X-ray tube as defined in claim 5 wherein the sensor is positioned outside the tube envelope.

7. An improvement in X-ray tubes of the type comprising a metal tube envelope having a wall portion, a rotating anode assembly therein and drive means for it, a cathode and power supply means for the anode and cathode including supply cables, the improvement comprising terminal means for connecting the supply cables to the anode and cathode, including:

(A) a feedthrough formed of insulating material sealed to and extending through the wall portion of the tube envelope and having a receptacle therein;

(B) wire means embedded in the feedthrough and extending from the receptacle to the interior of the tube for connection with the anode or cathode;

(C) metal shield means secured to the tube envelope and surrounding the feedthrough;

(D) insulating material within the metal shield means; and (E) a terminal end fitting receiving one of the supply cables and having electrical connectors carried by the terminal end fitting, said metal shield means and said insulating material in the metal shield means being provided with an opening which is sized to receive the terminal end fitting, said insulating material in the metal shield and the metal shield means having a small air channel therein extending from the receptacle to ambient exterior of the metal shield means to permit the escape of air from the opening when the terminal end fitting is inserted in the opening.

* * * * *